US010288295B2

(12) United States Patent
Chadwick et al.

(10) Patent No.: US 10,288,295 B2
(45) Date of Patent: May 14, 2019

(54) HOME COOKING APPLIANCE HAVING AN EXHAUST CHANNEL

(71) Applicants: BSH Home Appliances Corporation, Irvine, CA (US); BSH Bosch und Siemens Hausgeräte GmbH, Munich (DE)

(72) Inventors: Temple Chadwick, New Bern, NC (US); David Dysinger, New Bern, NC (US); Jesse Morrone, Cove City, NC (US); Norman Sewell, New Bern, NC (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 373 days.

(21) Appl. No.: 14/273,856

(22) Filed: May 9, 2014

(65) Prior Publication Data

US 2015/0323195 A1 Nov. 12, 2015

(51) Int. Cl.
*F24C 15/00* (2006.01)

(52) U.S. Cl.
CPC ..... *F24C 15/006* (2013.01)

(58) Field of Classification Search
CPC .. F24C 15/005; F24C 15/2042; F24C 15/006; F24C 15/2007
USPC ..... 126/21 A, 21 R, 15 A, 15 R, 273 R, 31
See application file for complete search history.

(56) References Cited

U.S. PATENT DOCUMENTS

| | | | | | |
|---|---|---|---|---|---|
| 2,526,890 | A * | 10/1950 | Mendel | F24C 3/027 | 126/190 |
| 3,832,988 | A * | 9/1974 | Doner | F24C 15/2007 | 126/21 R |
| 4,430,541 | A * | 2/1984 | Day, Jr. | F24C 15/322 | 126/21 A |
| 4,527,542 | A * | 7/1985 | Bales | F24C 15/2007 | 126/21 R |
| 6,172,338 | B1 * | 1/2001 | Barnes | F24C 15/006 | 126/21 R |
| 8,333,183 | B2 * | 12/2012 | Nam | F24C 15/006 | 126/273 R |
| 2013/0125764 | A1 * | 5/2013 | Jeong | F24C 15/2035 | 99/357 |

* cited by examiner

*Primary Examiner* — Avinash A Savani
*Assistant Examiner* — Rabeeul I Zuberi
(74) *Attorney, Agent, or Firm* — Michael E. Tschupp; Andre Pallapies; Brandon G. Braun

(57) ABSTRACT

A home cooking appliance includes a housing, a cooking surface on a top of the housing, a cooking compartment in the housing, a cooling air system conveying air through the housing, and an exhaust channel in fluid communication with the cooling air system, the exhaust channel disposed at a rear corner of the housing and exhausting a portion of the cooling air in an upward direction from the rear corner of the housing.

39 Claims, 24 Drawing Sheets

100

HOME COOKING APPLIANCE HAVING AN EXHAUST CHANNEL

CROSS-REFERENCES TO RELATED APPLICATIONS

This application is related to Applicants' co-pending U.S. applications, which are filed concurrently herewith, entitled "HOME COOKING APPLIANCE HAVING A REAR EXHAUST LOUVER," filed concurrently herewith, Ser. No. 14/273,852; and "HOME COOKING APPLIANCE HAVING A FAN CHANNEL," filed concurrently herewith, Ser. No. 14/273,864, each of which is incorporated herein by reference in its entirety.

FIELD OF THE INVENTION

The present invention is directed to a home cooking appliance having an exhaust channel, and more particularly, to a home cooking appliance having an exhaust channel in fluid communication with the cooling air system and having an outlet at a rear corner of the housing that exhausts air from the cooling air system.

BACKGROUND OF THE INVENTION

A conventional home cooking appliance, such as a slide-in gas range, includes a housing having a cooking compartment, such as a baking oven, convection oven, steam oven, warming drawer, etc., and a cooking surface formed, for example, by cooking grates disposed over gas burners on top of the housing. A conventional slide-in range is installed in a cooking area of a home kitchen with a rear wall of the appliance facing a back wall of the kitchen. The appliance typically is disposed between counters with floor cabinets below the counters. The kitchen may include wall cabinets mounted on the back wall of the kitchen either over the cooking surface of the range or over the adjacent floor cabinets, and/or another appliance or component, such as an over-the-range (OTR) microwave oven or an OTR convection microwave oven over the cooking surface.

Industry standards and regulations commonly dictate acceptable temperatures of the combustible back wall behind the appliance, acceptable temperatures of cabinets or components over the range or adjacent to the range, as well as acceptable door temperatures for the appliance, during high temperature events, such as during a self-cleaning cycle of the oven while all burners on the cooktop are on a highest heat setting. The appliance must be able to exhaust cooling air and flue gases from the cooking compartment to maintain acceptable door temperatures for the appliance, acceptable surface temperatures for the appliance, acceptable temperatures of a combustible back wall behind the appliance, and acceptable temperatures of cabinets or components over the range or adjacent to the range.

Conventional appliances include various structures and techniques designed to manage and dissipate the hot air being exhausted from the appliance while complying with industry standards and regulations. In order to provide enough air flow through the appliance to maintain acceptable surface temperatures and oven door temperatures and to protect components in and around the appliance, many conventional appliances use costly designs and door construction that increases the air flow through the door and the housing, and/or include raised vent trims on top of the appliance with greater air flow and louder fans. Additionally, conventional home cooking appliances may require a rear wall of the appliance to be spaced from the combustible back wall by a certain amount of clearance in order to manage and dissipate hot air from the appliance in order to improve compliance with the industry standards and regulations.

SUMMARY OF THE INVENTION

The present invention, as illustrated for example in the exemplary embodiments, is directed to a home cooking appliance including a housing, a cooking surface on top of the housing, the cooking surface having an upper surface, a cooking compartment in the housing, a cooling air system that conveys cooling air through the housing, and an exhaust channel in fluid communication with the cooling air system, the exhaust channel disposed at a rear corner of the housing and exhausting a portion of the cooling air in an upward direction from the rear corner of the housing.

In this way, the present invention provides a home cooking appliance that impedes a flow of hot air toward the sides of the appliance and directs flue heat inward while providing more outlet volume for the cooling air system. As explained below, the features of the exhaust channel enable the use of a substantially flush rear vent trim and one or more rear exhaust louvers for exhausting air from the housing in an upward direction substantially in a plane of the rear wall of the housing to increase air pressure along a kitchen wall adjacent to the rear wall of the appliance and create an air wash that impedes the flow of the air, flue gases, and other heated air from the cooktops from flowing or being drawn toward the sides of the appliance or the back wall of the kitchen, while maintaining acceptable temperatures at the back wall of the kitchen.

Other features and advantages of the present invention will be described below. To provide a better understanding of the invention, and for further clarification and background of the present invention, various aspects and considerations of a home cooking appliance having an exhaust channel, which have been recognized by the present invention, first will be explained in greater detail.

As explained above, in order to provide enough air flow through the appliance to maintain acceptable surface temperatures and oven door temperatures and to protect components in and around the appliance, many conventional appliances use costly designs and door construction that increases the air flow through the door and the housing with greater air flow and louder fans. Conventional appliances also use larger, raised vent trims on top of the appliance with greater air flow and louder fans. However, these conventional designs can require expensive redesigns of the oven door, cooling air system, and exhaust channel, along with more powerful and louder fans for moving the cooling air, thereby resulting in increased manufacturing costs and an increase in fan noise for the user. These designs also can take up valuable space inside the oven door and/or the housing of the appliance, as well as valuable space on the top of the appliance, thereby restricting a size, for example, of the cooking compartment and/or cooking surface on top of the appliance.

The present invention recognizes that a combination of factors, such as the rear vents being located at the rear of the cooking appliance away from the user, a low pressure at a surface of the back wall of the kitchen located behind the appliance, convective heat transfer from flue gases to the back wall of the kitchen, and the heated air exiting the rear vents in a vertical direction, can result in an increase in temperatures at areas of the back wall of the kitchen located behind the appliance, as well as at areas of other components that are adjacent to the appliance, such as wall-mounted kitchen cabinetry or other appliances such as an over-the-range (OTR) microwave. During operation of the appliance, cool air naturally flows in from the front of the range (from the kitchen). The hot air from the burners and oven naturally collect at the back wall, for example, due to factors such as, for example, a low pressure at a surface of the back wall and convective heat transfer from flue gases to the back wall of the kitchen. The present invention recognizes that if the air-flow is not controlled or optimized, this hot air may increase temperatures, and in some cases, result in damage to the combustible surfaces of the back wall or other components, such as an OTR microwave. The present invention also recognizes that, while the cook top burners are in operation, it is beneficial if the rear vent trim also directs the cook top heat away from the back wall without negatively affecting low simmer rates. Thus, the air-flow preferably can be managed in a way that reduces wall temperatures and component temperatures while maintaining passing combustion results at the gas burners and in the cooking compartment, while at the same time minimizing noise to the user.

To address these and other problems, a home cooking appliance has been provided with a rear vent trim that controls and manages the air flow by directing the flow of air from the rear vent trim forward and away from a combustible back wall of the kitchen while simultaneously reducing turbulence above the cooking surface, thereby minimizing temperatures on the combustible back wall of the kitchen and improving compliance with industry standards and regulations, while also maintaining passing combustion results at the gas burners and the cooking compartment, minimizing noise to the user, and providing a low profile, rear vent trim that is substantially flush with cooking grates of the home cooking appliance. This appliance deviates from the conventional designs, which increase a height of the vent above the cooking surface, and instead provides a low-profile rear vent trim that is substantially flush with the cooking surface, which provides a "built-in" appearance that it desirable by many users. The exemplary rear vent trim can include one or more openings for permitting air to exit from within the rear vent trim while directing the air away from the back wall. The rear vent trim is configured to separate cooling air and flue gases and to exhaust the separate cooling air and flue gas from different openings in the rear vent trim while directing both the cooling air and flue gas away from the back wall. In an example, the rear vent trim directs the separate cooling air and flue gases away from the back wall and splits the air such that different streams of air are directed beneath the cooking grates and above the grates. For example, the rear vent trim directs the separate cooling air away from the back wall and in a direction above the cooking grates, and directs the flue gases away from the back wall and in a direction beneath the cooking grates.

As a result, the rear vent trim provides three air-flow 'zones' for managing airflow over the cooking surface. For example, the rear vent trim includes one or more first openings providing a first zone in which air comes up from behind the appliance, exits the rear vent trim through a first opening or set of openings, and gently blows up and forward to cool the back wall. The rear vent trim includes a second opening or set of openings providing a second zone such that, when the oven is ON and a cooling fan is running, air is gently directed out of the second openings at angles away from the burners such that the air does not disrupt the burner flame even when a burner is on a lowest setting. The air from the second zone works in combination with the air from the first zone to gently spin the combined air flow up in a vortex away from the back wall and upper cabinets, for example, like a reverse-Coanda effect. The rear vent trim includes a third opening or set of openings in communication with one or more oven flues to provide a third zone such that hot air/flue gas (oven combustion) flows up from the gas cooking compartment, exits the third openings of the rear vent trim in a direction away from the back wall, and gently wisps out onto the cooktop spill tray on the top of the housing. The hot air/flue gas of the third zone moves into the air-stream created by the first zone and the second zone and away from the back wall and upper cabinets or other components, such as an OTR microwave.

In many (or most) operating conditions, the home cooking appliance having the rear vent trim effectively can control and manage the air flow by directing the flow of air from the rear vent trim forward and away from a combustible back wall of the kitchen while simultaneously reducing turbulence above the cooking surface, thereby minimizing temperatures on the combustible back wall of the kitchen and improving compliance with industry standards and regulations, while also maintaining passing combustion results at the gas burners and the cooking compartment, minimizing noise to the user, and providing a low profile, rear vent trim that is substantially flush with cooking grates of the home cooking appliance. However, the present invention recognizes that the air zones provided by the rear vent trim alone may not be sufficient to prevent some of the hot air from flowing toward the back wall or from cycling against the back wall of the kitchen in some circumstances or under some operating conditions.

For example, the present invention recognizes that, under some testing conditions for determining compliance with industry standards, all burners are turned on (e.g., at 80%) and the oven compartment is operating at a high-temperature (e.g., 475°) over a long period of time. Under these conditions, some hot air may continue to be drawn toward the back wall or cycle behind the air zones toward the back wall of the kitchen, thereby increasing a risk of exceeding acceptable testing temperatures for the back wall of the kitchen. Moreover, since the test is conducted over a long period of time, the air flow around the appliance may be influenced, for example, by other motion in the kitchen area, such as by a user walking through the room, which may result in the air zones not being sufficient to prevent hot air from flowing toward the back wall of the kitchen.

In order to more effectively control and manage the air flow around the appliance and improve compliance with industry tests and standards under various operating conditions of the appliance, a home cooking appliance has been provided that impedes the flow of hot air toward the back wall and/or impedes the cycling of the hot behind the air zones toward the back wall of the kitchen. Thus, rather than reducing the cooktop rates in order to comply with testing requirements or using larger, raised vent trims on top of the appliance with louder fans as in the conventional appliances, the present invention provides one or more rear vent louvers in communication with the cooling air system to more effectively control and manage the air flow around the appliance. As a result, the exemplary appliance having the rear exhaust louver and the rear vent trim enables the use of a low-profile rear vent trim having a flush installation with the cooking surface to be used, for example, with a high power cooktop (e.g., 60000 BTU/Hr) having, for example five (5) burners, while complying with industry standards and regulations.

Particularly, a home cooking appliance has been provided with a housing, a cooking surface on a top of the housing, a cooking compartment in the housing, a cooling air system conveying air through the housing, and a rear exhaust louver on the housing. The rear exhaust louver is in fluid communication with the cooling air system and exhausts a portion of the air from the housing in an upward direction substantially in a plane of the rear wall of the housing to increase air pressure along a kitchen wall adjacent to the rear wall of the appliance and create an air wash that impedes the flow of the air, flue gases, and other heated air from the cooktops from flowing or being drawn toward the back wall of the kitchen. The rear exhaust louvers can be located, for example, in a central position with respect to the width of the appliance to direct the air in the rear central area of the appliance in an upward direction along the rear wall and substantially in a plane of the rear wall such that the air flows upward beyond the top of the appliance to increase the air pressure along the central area of the back wall of the kitchen and creates an air wash that impedes the flow of the air, flue gases, and other heated air from the cooktops from flowing or being drawn toward the central area of the back wall of the kitchen. The home cooking appliance can include one or more openings in the substantially flush rear vent trim that are configured to exhaust a greater amount of air along the length of the rear vent trim, and particularly, a greater amount of air to the sides of the rear vent trim. In yet another exemplary embodiment, the home cooking appliance can include a plurality of rear exhaust louvers located, for example, across the width (e.g., the entire width) of the appliance along with a substantially flush rear vent trim. The plurality of rear exhaust louvers direct air from the cooling air system in an upward direction along the rear wall of the kitchen and substantially in a plane of the rear wall such that the air flows upward beyond the top of the appliance to increase the air pressure along the back wall of the kitchen and creates an air wash that impedes the flow of the air, flue gases, and other heated air from the cooktops from flowing or being drawn toward the back wall of the kitchen. The rear exhaust louvers extend across the entire width of the appliance, thereby creating a high pressure air wash by the air that extends across the entire width of the appliance along the back wall of the kitchen. Furthermore, the openings in the substantially flush rear vent trim can be configured to exhaust air along a central portion of the rear vent trim to push the hot air from the flues and cooktop (which is impeded from flowing toward the back wall by the air from the louvers) forward and away from the back wall of the kitchen.

In this way, the exemplary embodiment may impede a flow of most, or all, of the hot air toward the back wall such that the air from the openings in the substantially flush rear vent trim is sufficient to push the hot air from the flues and cooktop forward and away from the back wall of the kitchen, thereby reducing temperatures on the back wall and adjacent cabinetry during operation of the appliance. As a result, the present invention can provide an appliance having a substantially flush rear vent trim while providing sufficient control of the air flow around the appliance to comply with industry standards and requirements.

By providing one or more rear exhaust louvers on the appliance, and particularly on a rear wall of the appliance, the appliance increases the air pressure along a back wall of the kitchen adjacent to the appliance, thereby providing an air wash along the back wall that impedes or prevents a flow of hot exhaust air, which exits the top of the appliance from other outlets, and hot air from other components such as cooktop burners, from being drawn toward an adjacent back wall of the kitchen, or from being cycled against the adjacent back wall of the kitchen. As a result, these features enable the flow of hot exhaust air exiting the top of the appliance from other outlets to be more freely directed forward and away from the combustible back wall of the kitchen, while simultaneously reducing turbulence above the cooking surface. These features can assist with reducing temperatures, for example during cooktop testing, on components adjacent to the appliance, such as wall cabinets mounted on the back wall of the kitchen either over the cooking surface of the home cooking appliance or over the adjacent floor cabinets, and/or another appliance or component such as an over-the-range (OTR) microwave oven or an OTR convection microwave oven, thereby improving compliance with industry standards and regulations. These features can be combined with other means for managing temperatures at the back wall, top cabinet, and/or adjacent cabinets to effectively manage the hot air being exhausted from the appliance in a manner that contributes to a reduction in temperatures on components adjacent to the appliance, as well as a reduction in temperature on surfaces or components of the home cooking appliance itself, such as temperatures on an oven door, thereby improving compliance with industry standards and regulations.

By providing one or more rear exhaust louvers on the appliance, and particularly on a rear wall of the appliance, these features can increase pressure along the rear wall adjacent to the appliance, thereby helping to reduce wall temperatures and increase the outlet area and volume for the cooling air system of the appliance. The high pressure of the cooling fan air flow path from the rear exhaust louvers also creates low pressures around it, which can affect the angle of portions of air exhausting from other locations on the appliance (e.g., in communication with the cooling air system). Particularly, the air flowing from the rear exhaust louvers may operate to increase the pressure behind the air flow path of portions of other air (e.g., other air from the cooling air system) exhausting from other locations on the rear vent trim, thereby reducing an angle at which the other air flow paths need to be directed. Such a reduced angle may enable the cooling air system to manage a larger volume of air and/or a larger amount of heat. In operation, the cooling air is drawn into slots in the lower part of the door, up through the door, out of top slots in the door, into a mid plenum or cavity where the hot air mixes with cool air from the rear of the appliance, and then out of the openings in the rear vent trim and the rear exhaust louvers. The combination of the rear exhaust louvers and the rear vent trim enable the appliance to effectively control and manage the air flow around the appliance, the cooktop heat, and the temperatures of the back wall and adjacent cabinetry. In this way, these features can assist with reducing rear wall and top cabinet temperatures during cooktop testing. These features can be combined with other means for managing rear wall and top cabinet temperatures to effectively manage all of the cooktop heat.

The present invention recognizes that, during some scenarios of operation, some hot air may be pushed or drawn toward the sides of the rear vent trim and adjacent cabinetry and then up the back wall adjacent to the sides of the appliance. For example, in operation, the pressure may build across the front of the rear vent trim and push heat from the flue towards the sides of the appliance. Moreover, the heat coming out of the flue may exceed 350° C. However, in an appliance having a dual flue arrangement, the distance between the edge of the flue boundary and the side walls may be very small (e.g., 21 mm). As a result, the temperature must be reduced from the high temperatures at the flue (e.g., 350° C. or greater) to acceptable temperatures at the sides of the appliance (e.g., below 90° C.) in a very small amount of space.

The present invention recognizes that reducing the temperature of the cooling air or increasing the volume of the cooling air being exhausted from the appliance may not provide an acceptable solution since the pressure build up was not found to be related to the temperature or volume of the cooling air being exhausted from the appliance. Instead, the present invention recognizes that higher pressures building up across the front of the rear vent trim and lower pressures at the sides of the appliance result in hot air being pushed or drawn toward the sides of the rear vent trim and adjacent cabinetry and then up the back wall adjacent to the sides of the appliance. Therefore, the present invention recognizes that means are needed for impeding a flow of the hot air to the side of the appliance owing to the pressure buildup across the front of the rear vent trim, and for promoting or forcing a flow of the hot air from the flues inward toward the middle of the appliance.

To solve these and other problems, the exemplary embodiment of the present invention provide a home cooking appliance including an exhaust channel in fluid communication with the cooling air system, the exhaust channel disposed at a rear corner of the housing and exhausting a portion of the cooling air in an upward direction from the rear corner of the housing. In this way, the present invention provides a home cooking appliance that impedes a flow of hot air toward the sides of the appliance and directs flue heat inward while providing more outlet for the cooling air system. The exhaust channels can be configured to provide sufficient airflow to force or promote the flow of the hot air in toward the middle of the appliance. The air being exhausted from the exhaust channels does not need to be mixed with the flue gases; rather, the air flow at the corners of the appliance (and high air pressure at the corners of the appliance) can impede a flow of air toward the corners and side of the appliance while promoting a flow of hot air toward the middle of the appliance.

The exemplary exhaust channels can be spaced from the flues such that the air can be guided to and exhausted from the exhaust channels without transferring, or at least minimizing a transfer of, heat from the flues to the cooling air being guided to the exhaust channel so that the air exiting the corners of the appliance is not heated, thereby avoiding hot air at the corners of the appliance (and adjacent cabinetry, counters, etc.).

Moreover, the exemplary exhaust channels according to the present invention can reduce temperatures at the side of the appliance to within acceptable levels. For example, in operation, the exhaust channels can exhaust a portion of the cooling air from the cooling air system forward at an angle and, for example, under the cooking grates, thereby promoting or forcing a flow of the hot air forward and away from the back wall of the kitchen or the sides of the appliance and adjacent cabinetry. Furthermore, this forward or inward flowing cooling air may mix with the flue heat, thereby reducing the temperature of the air to within acceptable levels.

In the exemplary embodiments, the exhaust channels may reduce the temperatures at the side of the appliances from, for example, 110° C. to 90° C. The features of the exhaust channel enable the use of dual flues located adjacent to the sides of the appliance, rather than a cavity design requiring a single, center flue. As a result, the appliance can have cavities with a dual flue arrangement that uses limited space while providing an appliance that is compliant with industry standards and testing.

Additionally, the exemplary exhaust channels according to the present invention can be maximize the available space within the housing for channeling cooling air through the housing. The present invention can alleviate some of the pressure that may build up in the center area of the appliance due to the fan. For example, the exhaust channels, rear exhaust louvers on the rear wall, and/or rear exhaust louvers that are in fluid communication with the channel (for guiding air to the exhaust channels) can alleviate some of the pressure that may build up in the center area of the appliance from the cooling the fan by exhausting a portion of the cooling air from the pressurized plenum or cavity, thereby permitting the appliance to 'breath' and allowing the door and other air intakes to draw in fresh air into the cooling air system.

The features of the exhaust channel also enable the use of a substantially flush rear vent trim and one or more rear exhaust louvers for exhausting air from the housing in an upward direction substantially in a plane of the rear wall of the housing to increase air pressure along a kitchen wall adjacent to the rear wall of the appliance and create an air wash that impedes the flow of the air, flue gases, and other heated air from the cooktops from flowing or being drawn toward the sides of the appliance or the back wall of the kitchen, while maintaining acceptable temperatures at the back wall of the kitchen and providing sufficient airflow to push the hot air from the flues and cooktop forward and away from the back wall of the kitchen and the corners of the appliance, thereby reducing temperatures on the back wall and adjacent cabinetry during operation of the appliance. As a result, the present invention can provide an appliance having a substantially flush rear vent trim while providing sufficient control of the air flow around the appliance to comply with industry standards and requirements.

Other advantages of the exemplary exhaust channels, and particularly in combination with the rear exhaust louvers, rear vent trim, and fan channels, are that these exemplary arrangements do not blow hot air at a user, allow the burners to function effectively even at lowest settings (without nuisance clicking), allow installation of the appliance with an OTR component (such as an OTR microwave), allow installation of the appliance with a combustible rear wall, and maintain safe door temperatures and electronic component temperatures, even during self clean cycles, particularly when used in combination with other temperature control measures of the exemplary home cooking appliance. By effectively managing and controlling the flow of hot air (e.g., flue gas, cooling air, etc.), the exemplary appliance having the exemplary exhaust channels, rear exhaust louvers, rear vent trim, and fan channels can assist with balancing and optimizing the air flow in the cooling air system, thereby resulting in improved air flow in and around the appliance, which also results in improved baking results for the oven. Moreover, by effectively managing and controlling the flow of hot air, the exemplary appliance having the rear exhaust louver and the rear vent trim enables the use of a low-profile rear vent trim having a flush installation with the cooking surface to be used, for example, with a high power cooktop (e.g., 60000 BTU/Hr) having, for example five (5) burners, while complying with industry standards and regulations.

The features of the present invention can be provided separately, or in combination with each other or in combination with other features of a home cooking appliance for managing and dissipating the hot air being exhausted from the appliance, thereby further improving compliance with industry standards and regulations.

The features of the present invention are not limited to any particular type of cooking appliance or to a cooking appliance having any particular arrangement of features. For example, one of ordinary skill in the art will recognize that the features of the present invention are not limited to a slide-in gas cooking appliance, and can include, for example, a built-in cooking appliance such as a gas range or gas oven, an electric range or oven, or another cooking appliance that will benefit from distributing the hot air being exhausted from the appliance around the appliance, thereby minimizing temperatures on the combustible back wall of the kitchen or another component, and improving compliance with industry standards and regulations.

For purposes of this disclosure, the term "back wall" refers to a combustible wall of a kitchen that faces a rear wall of the appliance when the appliance is in an installed position.

For purposes of this disclosure, an upper surface of the rear vent trim is substantially flush with an upper surface of the cooking surface if the upper surface of the rear vent trim is approximately level with the upper surface of the cooking surface, or for example, if at least the front edge or rear edge of the upper surface of the rear vent trim is approximately level with the upper surface of the cooking surface, or for example, if at least a part of the upper surface of the rear vent trim is approximately level with the upper surface of the cooking surface. One of ordinary skill in the art will recognize that the upper surface of the rear vent trim, or any part thereof, does not need to be exactly the same height as the upper surface of the cooking surface for the upper surface of the rear vent trim to be substantially flush with the upper surface of the cooking surface.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

Figure 1:
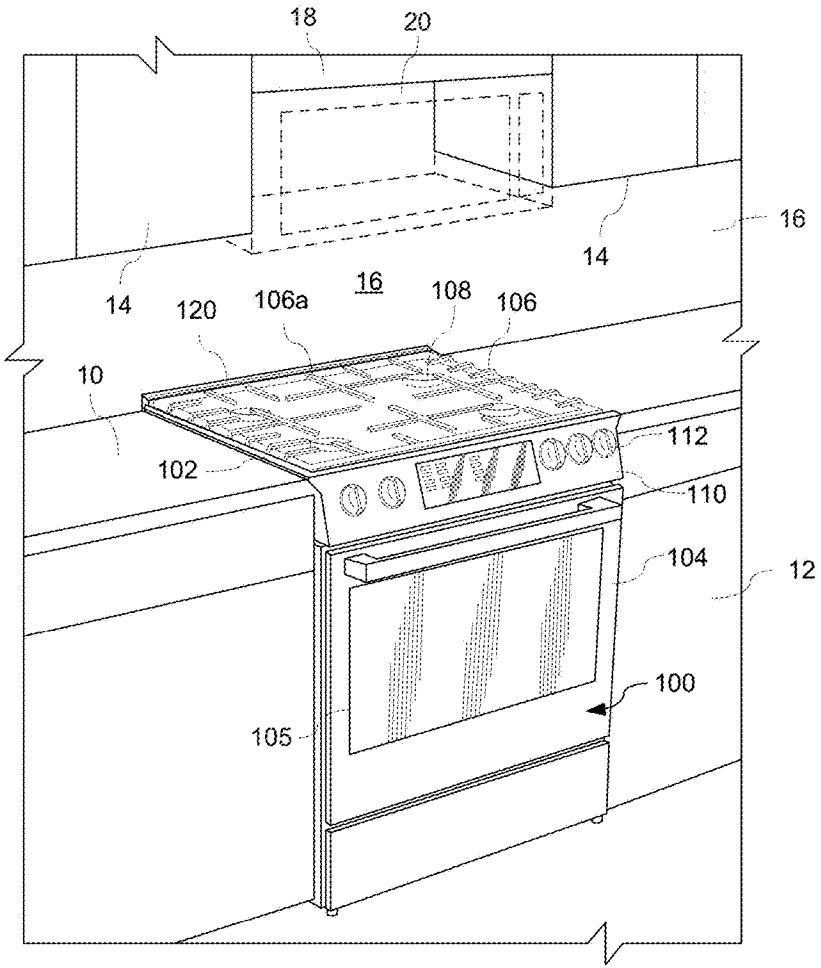
FIG. 1 is a front perspective view of a home cooking appliance according to an exemplary embodiment of the invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1-10B illustrate exemplary embodiments of a home cooking appliance having exhaust channels in fluid communication with a cooling air system and exhausting a portion of air from the housing of the appliance in an upward direction at each rear corner of the housing to increase air pressure at the rear corners of the appliance.

With reference to FIG. 1, a cooking area of a home kitchen may include counters 10 with floor cabinets 12 below the counters 10. The kitchen can include wall cabinets 14 on back wall 16 (e.g., a combustible back wall). A home cooking appliance 100, such as a slide-in home cooking appliance, can be disposed between the floor cabinets 12 and counters 10. A wall cabinet 18 or an over-the-range (OTR) microwave oven or convention microwave oven 20 can be disposed over the cooking surface 106 of the home cooking appliance 100.

With reference again to FIG. 1, an exemplary embodiment of a home cooking appliance 100 will now be described. The home cooking appliance 100 has a housing 102 with a cooking compartment, such as a baking oven, convection oven, steam oven, warming drawer, etc., in the housing 102 and accessible through a door 104 in a front of the housing 102. The door 104 has a door glass 105. The home cooking appliance 100 has a cooking surface 106 on a top of the housing 102. The cooking surface 106 can include one or more cooking grates having an upper surface 106*a* for supporting cookware over one or more gas burners 108. The appliance 100 includes a control panel 110 having a plurality of control knobs 112 for controlling the operation of the burners 108 and the cooking compartment.

As shown in FIG. 1, the housing 102 can include a rear vent trim 120 on the top of the housing 102 and at a rear side of the cooking surface 106. In an exemplary embodiment, the rear vent trim 120 can include an upper surface that is substantially flush with the upper surface 106*a* of the rear end of the cooking surface 110, thereby maximizing the cooking area of the appliance and providing a low-profile appearance. The rear vent trim 120 includes one or more openings (which will be explained in greater detail below with reference to FIGS. 6A-8D) for permitting air to exit from within the rear vent trim 120 while directing the air away from the back wall 16 (e.g., away from a 90° angle with respect to the upper surface of the cooking surface). The rear vent trim 120 (and particularly the openings in the rear vent trim) can be arranged in fluid communication with a cavity or duct for exhausting kitchen air up and away from the back wall 16, a cavity or duct for exhausting at least a portion of cooling air circulated or passed through the appliance (e.g., through the housing 102 and/or door 104 of the appliance 100), and/or one or more flues for exhausting flue gas from the cooking compartment (each of which will be explained in greater detail below with reference to FIGS. FIGS. 6A-8D). The rear vent trim 120 controls and manages the air flow by directing the flow of air from the rear vent trim 120 forward and away from a combustible back wall 16 of the kitchen (e.g., away from a 90° angle with respect to the upper surface of the cooking surface), thereby minimizing temperatures on the combustible back wall 16 of the kitchen and improving compliance with industry standards and regulations.

Figure 2A:
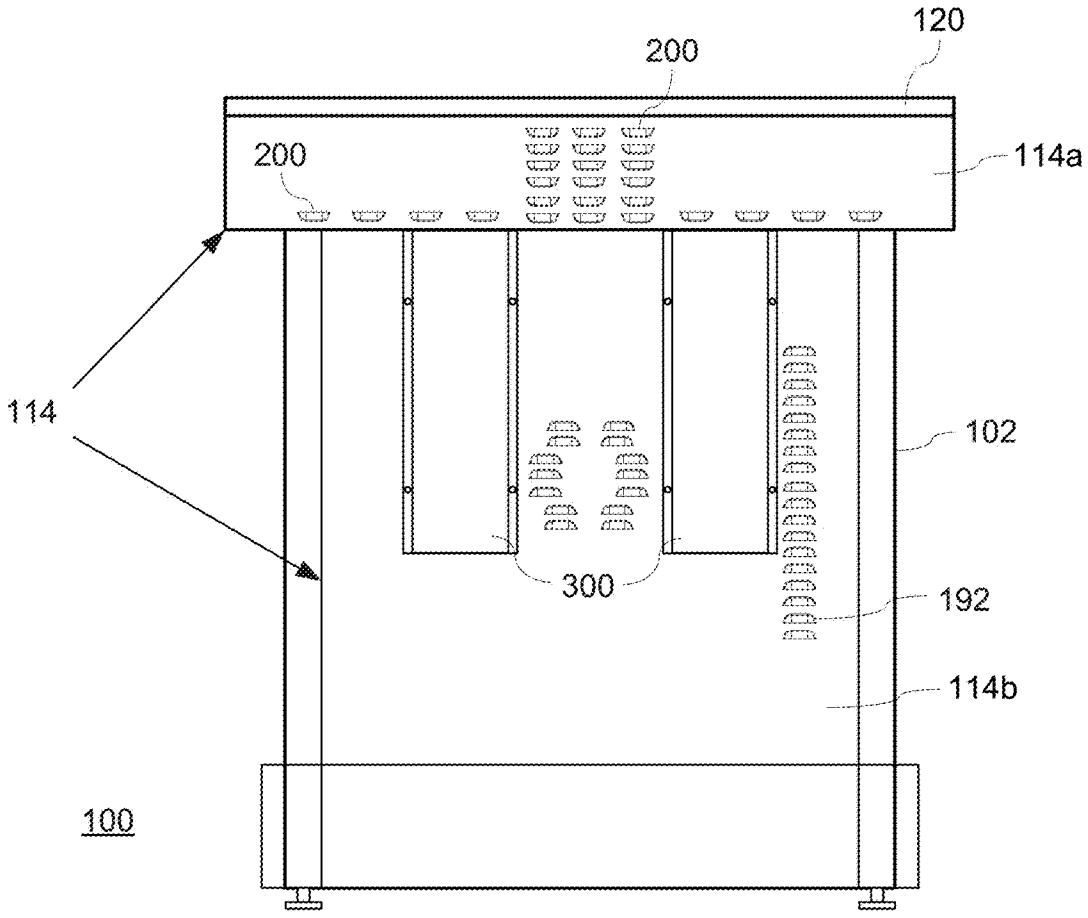
FIG. 2A is a rear view of a home cooking appliance having a fan channel according to an exemplary embodiment of the invention.
Figure 2B:
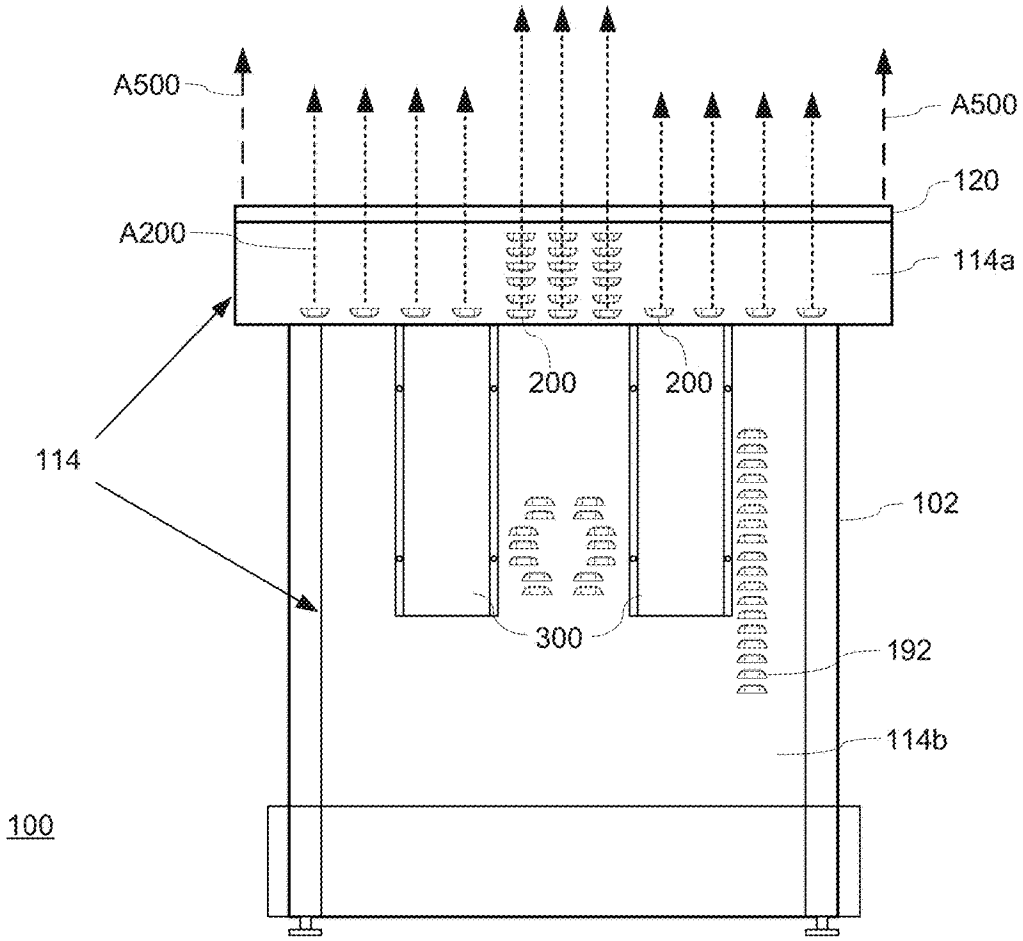
FIG. 2B is a rear view of the home cooking appliance having a fan channel according to the exemplary embodiment illustrated in FIG. 2A and schematically illustrating air flow patterns.
Figure 3:
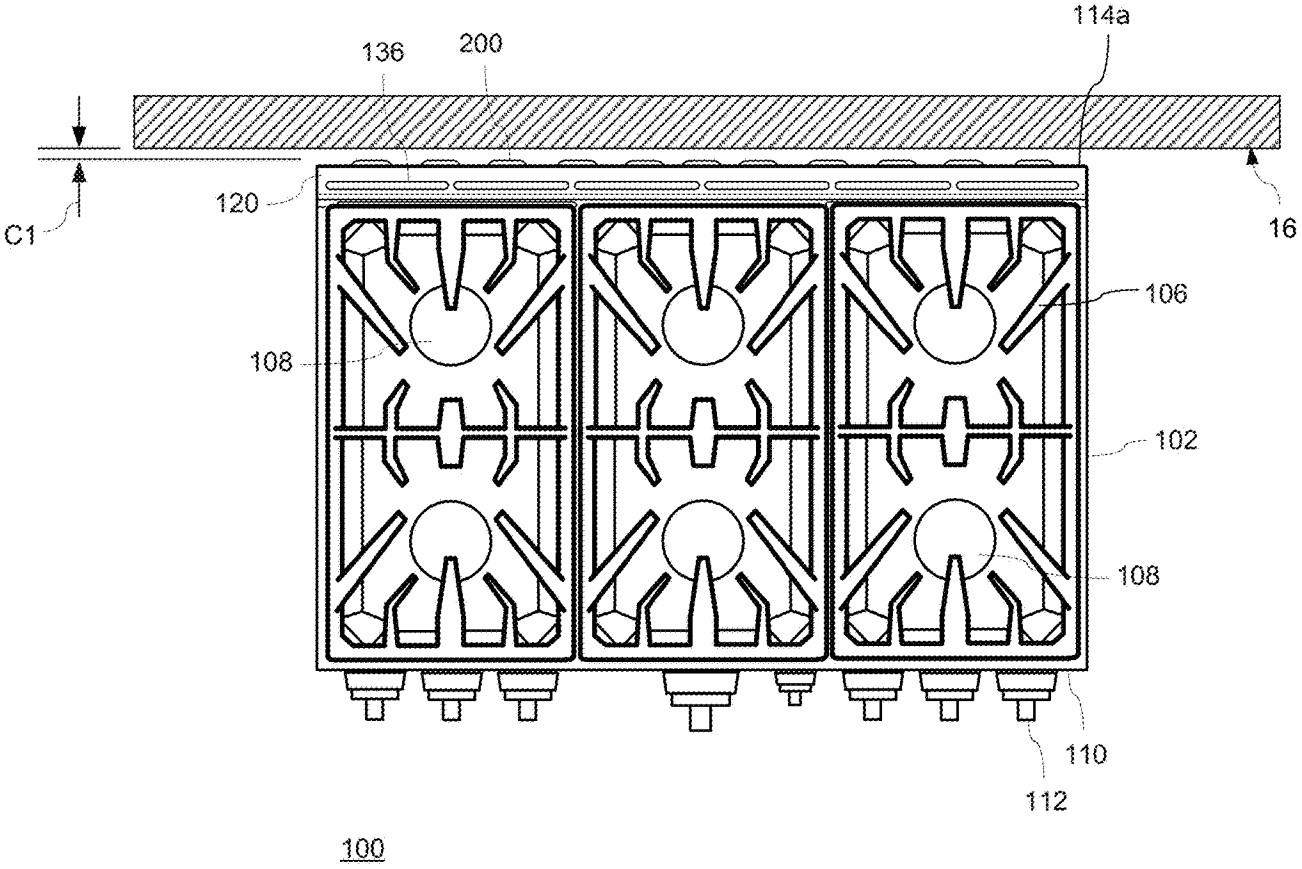
FIG. 3 is a top view of a home cooking appliance according to an exemplary embodiment of the invention.

With reference to FIGS. 2A-3, an exemplary embodiment of a home cooking appliance will now be described. The appliance 100 has a housing 102 with a rear wall 114 (114*a*, 114*b*) that faces the back wall of the kitchen when the appliance 100 is in an installed position. In this example, the rear wall 114 includes a first rear wall portion 114*a* at the rear side of the cooktop, and a second rear wall portion 114*b* at the rear side of the cooking chamber and below the first rear wall portion 114*a*. The first rear wall portion 114*a* and the second rear wall portion 114*b* can be coplanar with each other, or offset from each other. For example, in the illustrated example, the first rear wall portion 114*a* can be disposed further rearward (i.e., offset in a direction to the rear) from the second rear wall portion 114*b* as shown in FIG. 2A. For purposes of this disclosure, the first and second rear wall portions 114*a*, 114*b* will be referred to generally as the rear wall when referencing features on each respective surface.

The housing 102 includes a rear vent trim 120 arranged at a rear side of the top of the appliance 100. The rear vent trim 120 includes a plurality of openings (not visible in FIG. 2A) for exhausting air (e.g., air from the cooling air system, flue gases, etc.) from within the housing 102 while directing the air away from the back wall of the kitchen (e.g., away from a 90° angle with respect to the upper surface of the cooking surface). The appliance 100 can include one or more fan channels 300, for example on the rear wall 114, for drawing air into the cooling air system from areas outside of the appliance 100, such as from areas of lower temperature behind the appliance 100. The cooler air being drawn into the fan channels 300 can reduce the temperature of the air being exhausted in the upward direction from the rear exhaust louvers 200. The appliance 100 can include one or more inlets or openings 192, for example in the rear wall 114, for drawing kitchen air into the appliance 100 to cool electrical components or other components.

The appliance 100 can include one or more rear exhaust louvers 200 in fluid communication with a cooling air system of the appliance 100. The arrangement of the cooling air system will be explained in greater detail with reference to FIGS. 6A-7D. The rear exhaust louvers 200 can be configured to exhaust a portion of the air A200 from the cooling air system out of the housing 102 in an upward direction substantially in a plane of the rear wall 114 (e.g., 114*a* in the example) of the housing 102 to increase air pressure along a kitchen wall adjacent to the rear wall 114*a* of the appliance 100. The upward direction can be a substantially vertical upward direction (e.g., substantially 90°) at the exit of the rear exhaust louver 200, as shown in FIG. 2B. In other embodiments, the rear exhaust louvers 200 can be configured to exhaust a portion of the air A200 of the cooling air system from the housing 102 in an upward direction that is not vertical (e.g., at an angle that is greater than 0° and less than 90°) at the exit of the rear exhaust louver 200.

The appliance 100 includes one or more exhaust channels (not visible in FIGS. 2A and 2B) that exhaust air A500 (illustrated in FIG. 2B) from the cooling air system from openings at the corners of the rear vent trim 120. In this example, the air A500 is exhausted in an upward direction from openings in the rear vent trim 120 at the corners of the appliance, thereby creating a high pressure area or air stream of the air A500 at each corner of the appliance 100 to impede the flow of hot air toward the corners of the appliance.

FIG. 3 illustrates an exemplary embodiment of an appliance having a plurality of rear exhaust louvers 200 in an installed position adjacent to a back wall 16 of a kitchen. As will be explained in greater detail below, the rear exhaust louvers 200 and the rear vent trim 120 cooperate to control and manage the air flow above the cooking surface 106, thereby minimizing temperatures on the combustible back wall 16 of the kitchen and improving compliance with industry standards and regulations, while also maintaining passing combustion results at the gas burners 108 and the cooking compartment, minimizing noise to the user, and providing a low profile, rear vent trim 120 that is substantially flush with cooking grates 106 of the home cooking appliance 100. As a result, the present invention can minimize, or some in cases, eliminate a required minimum clearance C1 between the rear wall 114*a* of the appliance 100 and a combustible back wall 16 of the kitchen, which faces the rear wall 114*a* of the appliance, while maintaining compliance with industry standards and regulations. In an exemplary embodiment, the rear exhaust louvers 200 and the rear vent trim 120 control and manage the air flow to such an extent that very little spacing is needed between the rear wall of the appliance and the combustible back wall 16 of the kitchen in order to maintain compliance with industry standards and regulations, and therefore, the rear wall of the appliance can be moved into close proximity with the combustible back wall 16 of the kitchen, thereby maximizing the use of space in the kitchen and further improving the "built-in" appearance of the appliance. In another exemplary embodiment, the rear exhaust louvers 200 and the rear vent trim 120 control and manage the air flow to such an extent that any need for a required clearance between the rear wall 114*a* and the combustible back wall 16 of the kitchen can be entirely eliminated, thereby permitting the rear wall 114*a* (or at least the rear exhaust louvers 200 on the rear wall 114*a*) of the appliance to directly abut or contact the combustible back wall 16 of the kitchen, while maintaining compliance with industry standards and regulations.

With reference to FIGS. 4A-4F, exemplary embodiments of a rear panel 400, which forms the rear wall 114*a* of the illustrated appliance 100, will now be described.

The rear panel 400 includes a bottom wall 172, 174, side walls 176, and a rear wall 114*a* forming the exterior rear wall of the appliance. The rear panel 400 can include one or more rear exhaust louvers 200 for permitting air to be exhausted from the appliance 100. The rear exhaust louver 200 can be configured to open in an upward direction such that the air exits the rear exhaust louver 200 and flows in an upward direction substantially in a plane of the rear wall 114*a* of the housing 102 to increase air pressure along a kitchen wall adjacent to the rear wall 114*a* of the appliance 100.

Figure 4A:
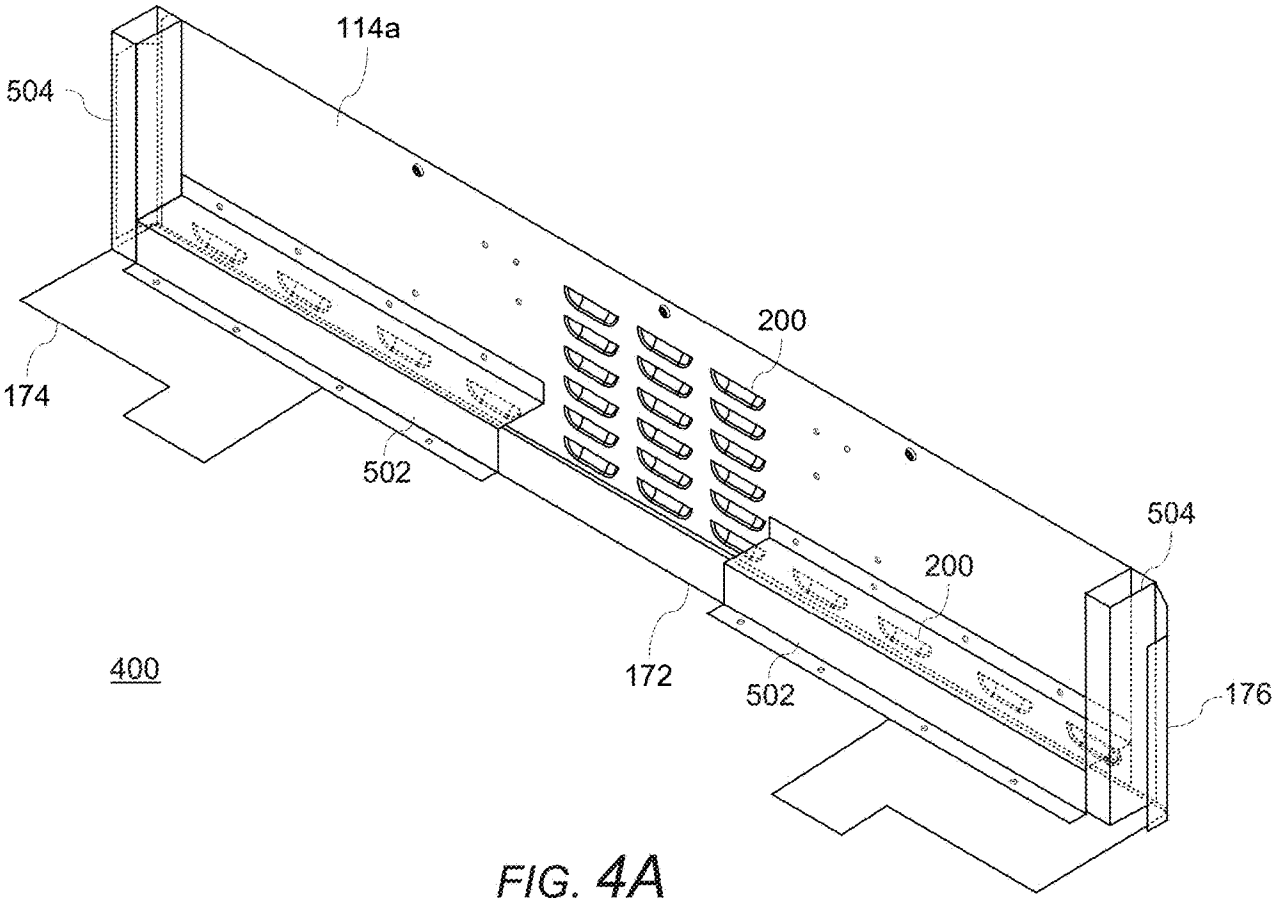
FIG. 4A is a front perspective view of a rear panel of a home cooking appliance having an exhaust channel according to an exemplary embodiment of the invention.
Figure 4B:
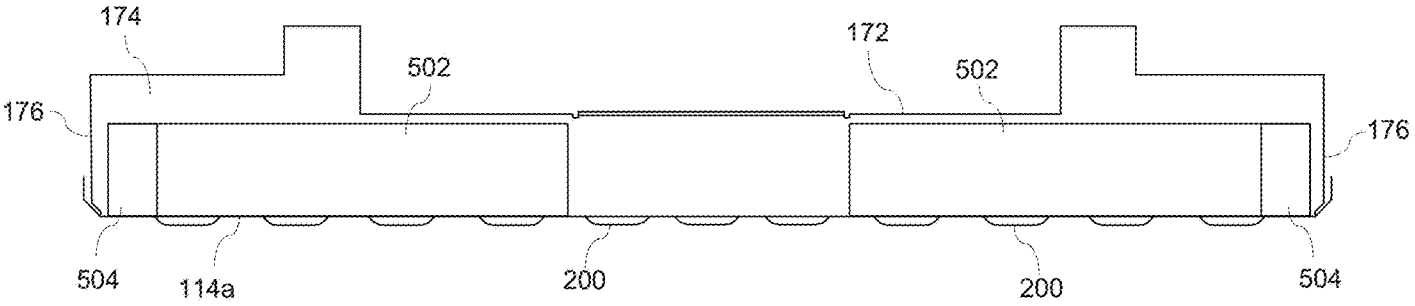
FIG. 4B is a bottom view of a rear panel of a home cooking appliance having an exhaust channel according to the exemplary embodiment illustrated in FIG. 4A.
Figure 4C:
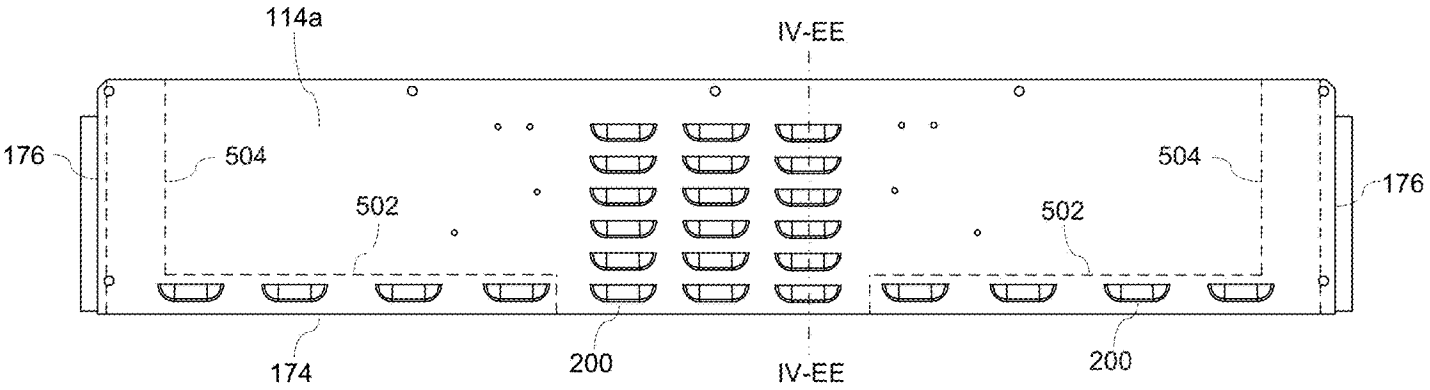
FIG. 4C is a rear view of a rear panel of a home cooking appliance having an exhaust channel according to the exemplary embodiment illustrated in FIG. 4A.
Figure 4E:
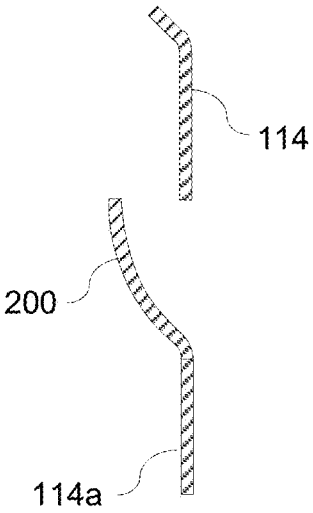
FIG. 4E is a partial cross-sectional view of the rear exhaust louver of the rear panel according to the exemplary embodiment taken along section IV-EE in FIG. 4C.
Figure 4D:
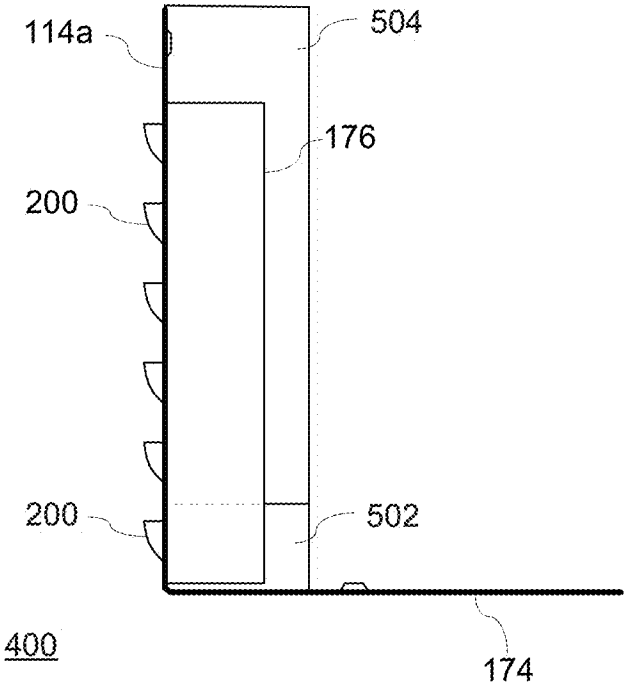
FIG. 4D is a side view of a rear panel of a home cooking appliance having an exhaust channel according to the exemplary embodiment illustrated in FIG. 4A.

The rear exhaust louvers 200 can be formed in the rear wall 114*a* by stamping the sheet metal of the rear panel 400 or by other suitable means. In other embodiments, the rear exhaust louver 200 can be a separate component coupled to an opening formed in the rear wall 114*a*. The cross-sectional shape of the rear exhaust louver 200 can have a curved wall as shown in FIG. 4E, an angled linear wall (not shown), or another suitable shape that directs the exhausting air in an upward direction as the air exits the louver. In other embodiments, the rear exhaust louver 200 can be configured to work in cooperation with a back wall of the kitchen located behind the appliance such that the rear exhaust louver 200 exhausts the air onto the back wall of the kitchen in such a way that the air is deflected by the back wall into the upward direction. For example, the rear exhaust louver can include one or more deflectors (e.g., internally mounted deflector(s)) that direct the air from the exit opening of the rear exhaust louver in the upward direction along the exterior surface of the rear wall 114*a* of the housing. In this example, an embodiment of the rear exhaust louver may be formed substantially flush with the rear wall 114*a*.

In the illustrated examples, the rear exhaust louvers 200 are formed in the rear wall 114*a*. However, one or more rear exhaust louvers 200 can be formed in other areas of the appliance 100 so long as the air (e.g., A200 in FIG. 4F) can exhaust in an upward direction along the rear wall 114 (e.g., 114*a*) of the appliance and continue to flow upward beyond the top of the appliance to increase the air pressure along the back wall of the kitchen and create an air wash that impedes the airflow exiting the appliance from other locations (e.g., flue exhaust, etc.) from flowing toward the back wall. For example, a rear exhaust louver 200 can be formed in a rear side of the vent trim 120, or in other areas of the rear wall 114 of the appliance. For example, a rear exhaust louver 200 can be formed in the second portion (i.e., lower portion) 114*b* of the rear wall 114 if, for example, the first and second portions of the rear wall 114*a*, 114*b* are coplanar, or if pathways are provided in or on the first portion (i.e., upper portion) 114*a* of the rear wall 114 to permit the air A200 to flow in an upward direction along the rear wall of the appliance and continue to flow upward beyond the top of the appliance to increase the air pressure along the back wall of the kitchen and create an air wash that impedes the airflow exiting the appliance from other locations (e.g., flue exhaust, etc.) from flowing toward the back wall. In another example, one or more rear exhaust louvers 200 can be formed in a top, rear side of the vent trim 120 to exhaust the air in an upward direction upward from the top of the appliance and along the back wall of the kitchen to increase the air pressure along the back wall of the kitchen and create an air wash that impedes the flow of air from outer exits from approaching the back wall.

Figure 4F:
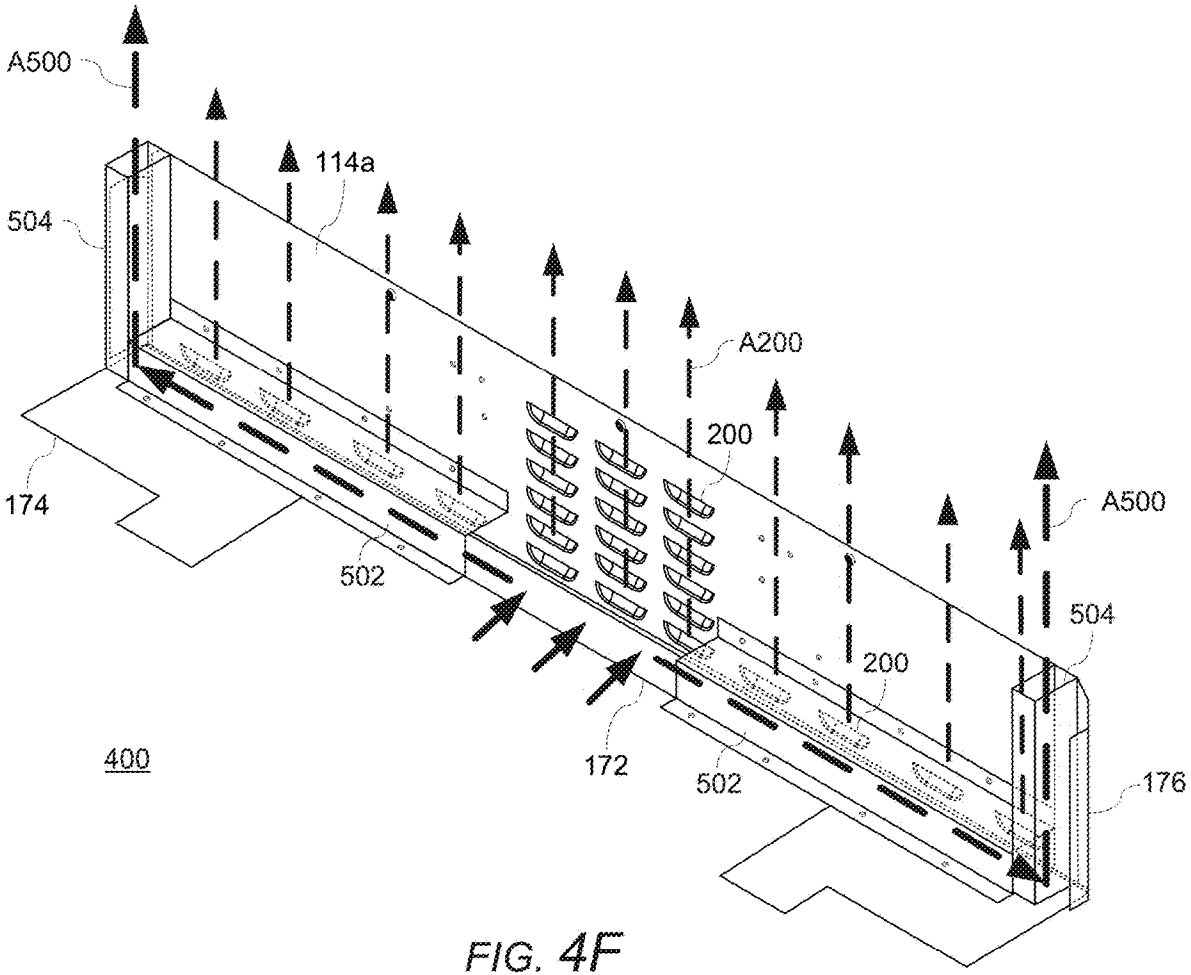
FIG. 4F is a front perspective view of the rear panel of FIG. 4A, schematically illustrating air flow paths.

With reference again to FIGS. 4A-4F, the rear panel 400 includes one or more channels or tubes 502, 504 configured to guide a portion of the cooling air to one or more of the rear exhaust louvers 200. For example, the rear panel 400 can include one or more channels 502 to guide a portion of the cooling air toward the sides of the panel 400 such that the cooling air can exit the rear exhaust louvers 200 positioned across the width of the rear panel 400. The size and shape of the channels 502 can be selected to assist with controlling or balancing the airflow through the respective rear exhaust louvers 200, rear vent trim, the doors, the fan, etc. The channels 502 can be formed from sheet metal and cooperate with the inside surface of the rear panel 114*a* to form an air channel. In other embodiments, the channels 502 can be separately formed components forming an air channel extending from an area or cavity close to the outlet of the cooling fan (e.g., in this example, central area), along the rear wall 114*a*, and to an area toward the side or corner of the rear panel 400 of the appliance 100. As shown in FIG. 4F, in operation, a portion of the cooling air exits the rear exhaust louvers 200 located in the center of the rear panel 400 and other portions of the cooling air flow into each of the channels 502 and exit the rear exhaust louvers 200 extending across the width of the rear panel 400. The channels 502 are not limited to the illustrated embodiment and can have other shapes, sizes, positions, or arrangements to direct the cooling air to various louver locations. In addition to, or as an alternative to, guiding the air to the rear exhaust louvers 200, one or more channels 502 can guide a portion of the cooling air to one or more exhaust channels 504 located at the sides of the rear panel 400, and the air A500 (shown in FIG. 4F) then can be exhausted from the cooling air system from openings (e.g., 136 in FIGS. 6A-6D described in greater detail below) in the rear vent trim 120, which are disposed over the exhaust channels 504 at the corners of the appliance 100. Each channel 502 can guide the air to both the rear exhaust louvers 200 and an exhaust channel 504, or to only the rear exhaust louvers 200 or only an exhaust channel 504.

With reference again to FIGS. 4A-4F, the rear panel 400 includes one or more exhaust channels 504 at the sides or ends of the rear panel 400 such that the exhaust channels 504 are located at the rear corners of the appliance when the rear panel 400 is in an assembled state on the appliance. The exhaust channels 504 are in fluid communication with the plenum or cavity that receives air from the cooling fan such that the cooling fan pushes a portion of the cooling air into the exhausts vents 504, where the air A500 (shown in FIG. 4F) then is exhausted from the cooling air system from openings (e.g., 136 in FIGS. 6A-6D described in greater detail below) in the rear vent trim 120, which are disposed over the exhaust channels 504, at the corners of the appliance 100 to create a high pressure air or stream of air A500 at the corners of the appliance that impede a flow of hot air toward the sides of the appliance. As shown in FIGS. 4A-4F, the exhaust channels 504 can be formed by vertical tubes or channels that guide the air from within the housing to one or more openings at the outside ends of the rear vent trim. The size, shape, and arrangement of the channels 504 are not limited to any particular arrangement. The size, shape, and arrangement of the channels 504 can be selected to control or balance an amount of air flowing to the exhaust channels 504 and rear exhaust louvers 200. The channels 504 can be formed from sheet metal and cooperate with the inside surface of the rear panel 114*a* to form an air channel. In other embodiments, the channels 504 can be separate elements forming an air channel that guides the cooling air to one or more openings in the rear vent trim 120 at the corner of the appliance.

As explained above, the exhaust channel 504 can be arranged in fluid communication with the channels 502 such that a portion of the cooling air can be pushed through the channel 502 and into the exhausts vents 504 by the cooling fan, and then the air A500 (shown in FIG. 4F) can be exhausted from the cooling air system from openings (e.g., 136 in FIGS. 6A-6D described in greater detail below) in the rear vent trim 120, which are disposed over the exhaust channels 504 at the corners of the appliance 100. In other embodiments, one or more exhaust channels 504 can be arranged in fluid communication with a plenum or cavity that is pressurized by air from the cooling fan such that a portion of the cooling air can be pushed into the exhausts vents 504 and then the air A500 (shown in FIG. 4F) can be exhausted from the cooling air system from openings in the rear vent trim 120, which are disposed over the exhaust channels 504 at the corners of the appliance 100, thereby creating a high pressure area or air stream by the air A500 at each corner of the appliance 100 to impede the flow of hot air toward the corners of the appliance.

Figure 5A:
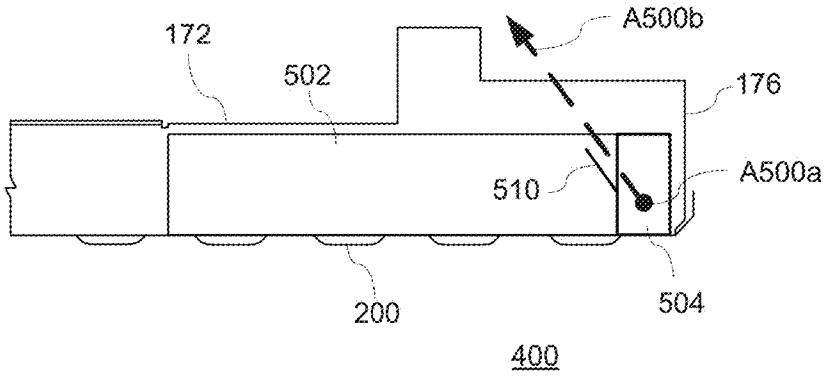
FIG. 5A is a partial top view of a rear panel of a home cooking appliance having a rear exhaust louver with a deflector according to another exemplary embodiment of the invention.
Figure 5B:
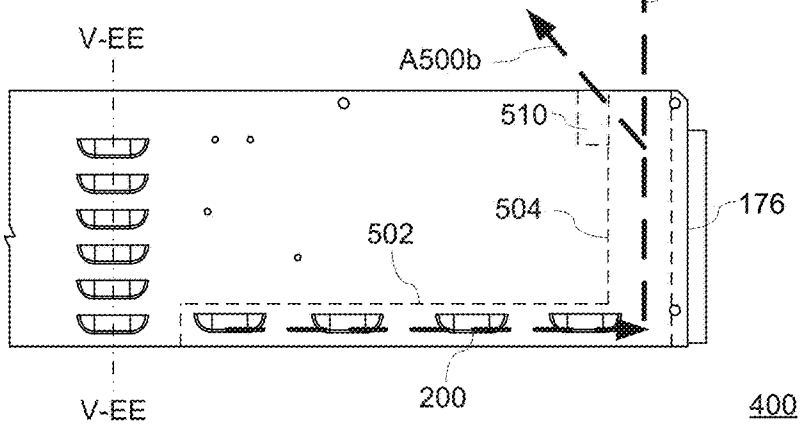
FIG. 5B is a partial rear view of the rear panel having the rear exhaust louver with the deflector according to the exemplary embodiment of the invention in FIG. 5A.
Figure 6A:
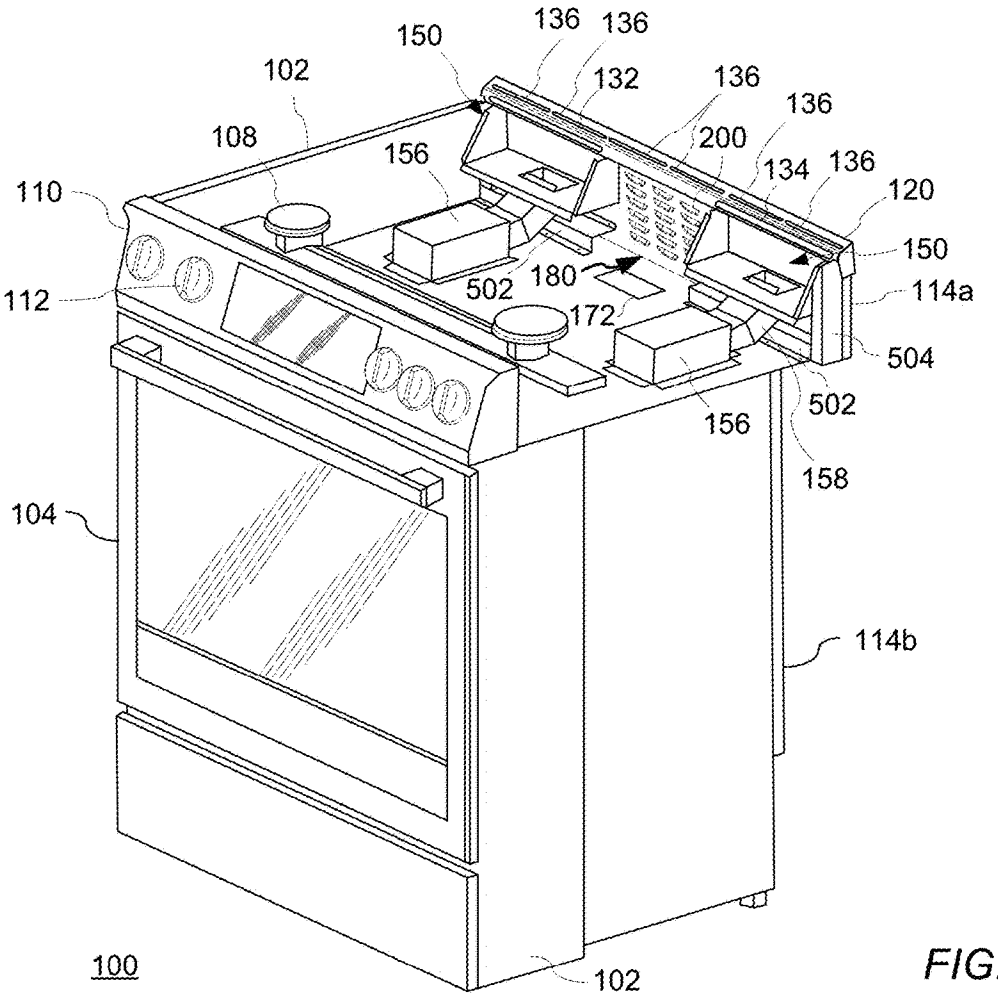
FIG. 6A is a schematic, cut-away front perspective view of a home cooking appliance according to an exemplary embodiment of the invention.
Figure 6B:
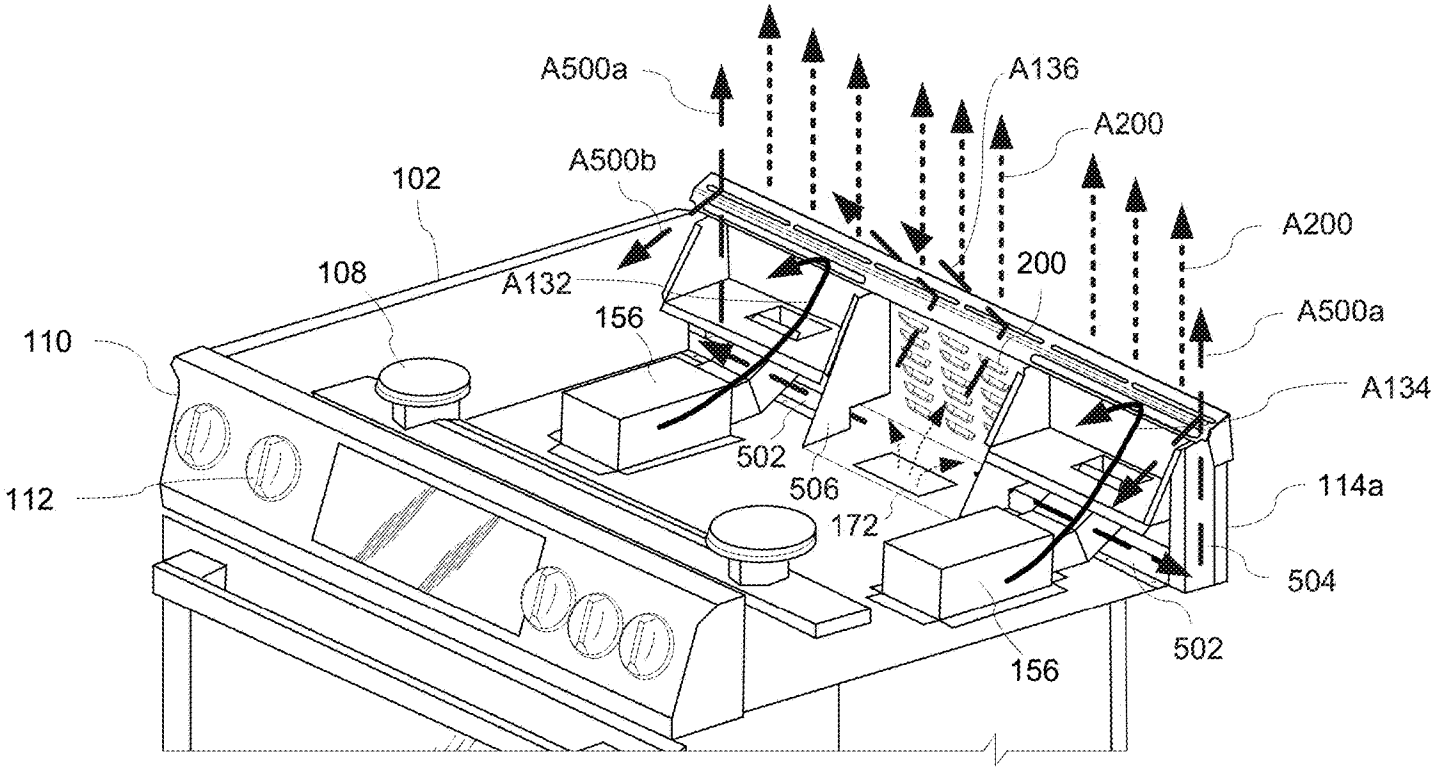
FIG. 6B is a partial, schematic, cut-away front perspective view of the home cooking appliance illustrated in FIG. 6A showing air flow paths.
Figure 6D:
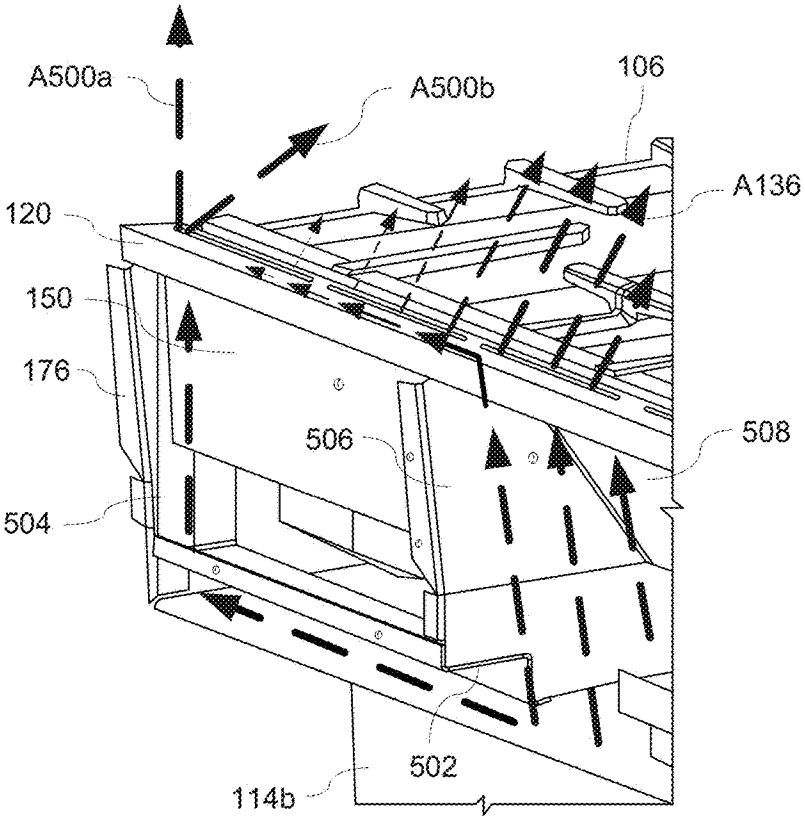
FIG. 6D is a partial rear perspective view of the home cooking appliance illustrated in FIG. 6C, schematically illustrating air flow paths.
Figure 6C:
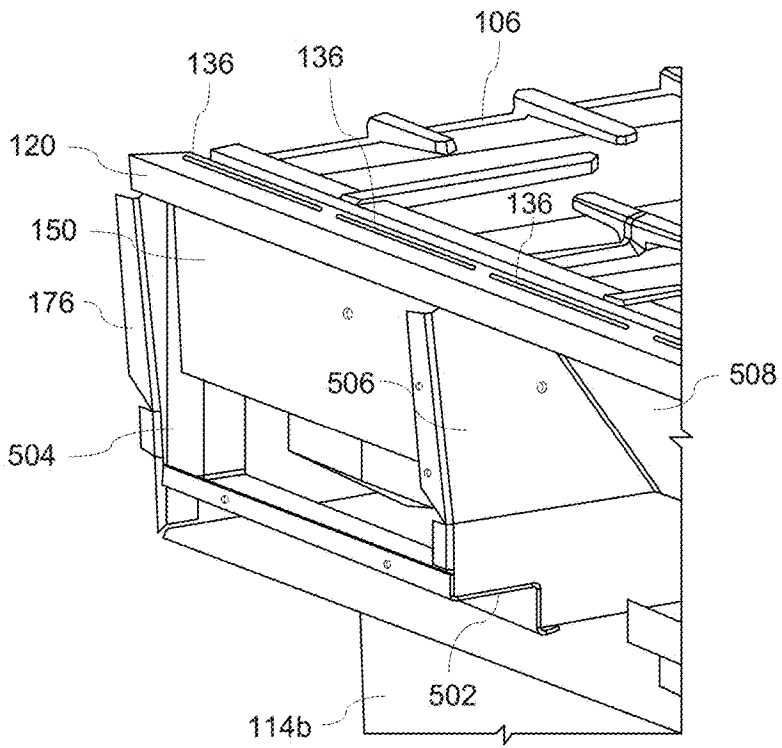
FIG. 6C is a partial rear perspective view of the home cooking appliance illustrated in FIG. 6A.

With reference to FIGS. 5A and 5B, in another exemplary embodiment, the air exhausting from the exhaust channel 504 can be directed or split into more than one air stream or direction. For example, in the illustrated embodiment, a first portion of the air A500*a* is exhausted in an upward direction to, for example, an opening in the rear vent trim such that the air A500*a* flows in an upward direction from the corners of the appliance. A second portion of the air A500*b* is directed in a forward direction away from the back wall 16 of the kitchen (e.g., away from a 90° angle with respect to the upper surface of the cooking surface 106). In the illustrated example, the rear panel 400 includes a deflector 510 that directs the second portion of the air from the exhaust channel 504 away from the vertical direction to create a high pressure area or air stream by the air A500*b* in a forward direction along the side of the appliance 100 to impede the flow of hot air toward the sides of the appliance and assist with promoting a flow of heated air from the appliance in a forward and upward direction rather than toward the side of the appliance or toward a back wall of the kitchen. The deflector 510 can direct the air A500*b* through one or more openings (e.g., 136 in FIGS. 6A-6D described in greater detail below) in the rear vent trim 120. However, in other embodiments, the rear vent trim 120 can include a diverter or deflector that directs a portion of the air from the exhaust channel away from the vertical direction. The diverter or deflector also can be a separate component from the exhaust channel 504, rear panel 400, or rear vent trim 120.

FIGS. 6A-6D illustrate an exemplary embodiment of a home cooking appliance having an exhaust channel 504. The cooking surface 106, the cooktop drip tray, and several of the burners 108 have been omitted in FIGS. 6A and 6B to show the arrangement of the components of the appliance and to more clearly show the air flow paths within the appliance that flow to the rear exhaust louvers 200, the channel 502, the exhaust channels 504, and the openings 132, 134, and 136 of the rear vent trim 120. The rear panel 400 has been omitted in FIGS. 6C and 6D to show the arrangement of the components of the appliance and to more clearly show the air flow paths within the appliance that flow to the channel 502, the exhaust channels 504, and the openings 132, 134, and 136 of the rear vent trim 120.

The exemplary appliance 100 includes a housing 102 having a cooking compartment (not shown) accessible through a door 104, cooktop burners 108, and a control panel 110 having a plurality of control knobs 112 for controlling the operation of the burners 108 and the cooking compartment. The appliance 100 includes a substantially flush, low-profile rear vent trim 120 arranged at a rear side of the top of the appliance 100. The rear vent trim 120 includes a plurality of openings 132, 134, 136 for exhausting air from respective areas of the appliance.

The cooking compartment has a dual flue arrangement having flues 156, each of which exhausts flue gases from the cooking compartment (not shown) through a flue duct 158 and into a flue boundary 150. In operation, the flue gases A132, A134 (shown in FIG. 6B) are exhausted from the flue boundaries 150 via the openings 132, 134 in the rear vent trim 120. The rear vent trim 120 can be configured to exhaust the flue gases A132, A134 from the openings 132, 134 while directing the flue gases A132, A134 away from the back wall of the kitchen (e.g., away from a 90° angle with respect to the upper surface of the cooking surface). In the illustrated example, the rear vent trim 120 is configured to direct the flue gases A132, A134 away from the back wall of the kitchen (e.g., away from a 90° angle with respect to the upper surface of the cooking surface), and more particularly, in a forward direction under the cooking grates of the cooktop. In an exemplary embodiment, the cooking surface (e.g., cooking grate 106 shown in FIGS. 1 and 3) can include one or more slots (e.g., grate slots) corresponding to one or more of the openings 132, 134 and formed in a lower side of a part of the cooking surface to permit the air A132 exiting from the respective openings 132, 134 to pass under the cooking surface, for example, with minimal or no interference or disruption to the air flow.

The appliance 100 includes a mid plenum, cavity, or duct 180 in fluid communication with the cooling air system (not shown) for cooling the cooking compartment and other components of the appliance using cooling air that is circulated through the appliance (e.g., through the housing 102 and/or door 104 of the appliance 100) by a fan (not shown). The fan (not shown) is located within the housing of the appliance and forces cooling air into the cavity 180 via an opening 172. The cavity 180 includes sidewalls 506 and a front wall 508 (shown in FIGS. 6C and 6D; omitted in FIGS. 6A and 6B for clarity). The appliance 100 includes a rear wall 114*a*, which also forms a rear wall of the cavity 180, having a plurality of rear exhaust louvers 200 configured to exhaust air from the appliance in an upward direction substantially in a plane of the rear wall 114*a*. The rear vent trim 120 includes openings 136 arranged in fluid communication with the cavity 180 for exhausting a portion of the cooling air A136 from the appliance. In the illustrated example, the openings 136 in the rear vent trim 120 are configured to direct the air A136 away from the back wall of the kitchen (e.g., away from a 90° angle with respect to the upper surface of the cooking surface), and more particularly, in a forward direction above the cooking grates of the cooktop.

The appliance 100 includes one or more channels 502 for permitting the cooling air to flow from the cavity 180 to the rear exhaust louvers 200 at other locations on the rear wall 114*a* away from the cavity 180. The channels 502 are spaced from other components, such as the flu boundaries, flue ducts, etc., to minimize or prevent heat transfer from high temperature components to the cooling air. The appliance 100 includes one or more exhaust channels 504 for permitting a portion A500*a* of the cooling air to flow from the channels 502 to one or more of the openings 136 located at the sides of the rear vent trim 120. In the illustrated example, the rear vent trim 120 is configured to direct a first portion of air A500*a* in an upward direction (e.g., vertically) and a second portion of air A500*b* in a forward direction away from the back wall of the kitchen and above the cooking grates of the cooktop (e.g., away from a 90° angle with respect to the upper surface of the cooking surface).

With reference again to FIGS. 6A-6D, during operation of the appliance 100, the flue gases A132, A134 from the cooking compartment flow through the flues 156 and flue ducts 158 into the flue boundaries 150, where the flue gases A132, A134 are then exhausted from the appliance 100 via the openings 132, 134 in the rear vent trim 120. The openings 132, 134 direct the flue gases A132, A134 away from the back wall of the kitchen (e.g., away from a 90° angle with respect to the upper surface of the cooking surface), and more particularly, in a forward direction under the cooking grates of the cooktop. The cooling fan (not shown) circulates cooling air through the appliance (e.g., through the housing 102 and/or door 104 of the appliance 100) to cool the cooking compartment and other components of the appliance.

The cooling fan forces the cooling air into the cavity 180 via the opening 172 and pressurizes the cavity 180 such that a portion of the air (e.g., A136) is pushed out of the openings 136 in the rear vent trim 120. The air A136 can exit the openings 136 at the center of the rear vent trim 120 and/or the openings 136 at other locations along the rear vent trim 120. The openings 136 in the rear vent trim 120 are configured to direct the air A136 away from the back wall of the kitchen (e.g., away from a 90° angle with respect to the upper surface of the cooking surface), and more particularly, in a forward direction above the cooking grates of the cooktop.

Owing to the high pressure in the cavity 180, a portion A200 of the cooling air in the cavity 180 is pushed out of the rear wall 114*a* of the appliance through the rear exhaust louvers 200. A portion of the cooling air is forced from the cavity 180 into the channels 502, which guide the air to additional rear exhaust louvers 200 (not visible in FIGS. 6A and 6B), such that air A200 exits from the additional louvers 200. The rear exhaust louvers 200 direct the air A200 in an upward direction along the rear wall 114*a* and substantially in a plane of the rear wall 114*a* such that the air A200 flows upward beyond the top of the appliance to increase the air pressure along the back wall of the kitchen and create an air wash that impedes the flow of the flue gases A132, A134, the air A136, and other heated air from the cooktops from flowing toward the back wall of the kitchen.

A portion (e.g., A500) of the air in the channels 502 is conveyed by the additional exhaust channels 504 to the openings 136 at the sides of the rear vent trim 120, where the air A500*a* is directed in an upward direction (e.g., vertically) from the openings 136 at the sides of the rear vent trim 120 and the air A500*b* is directed in a forward direction away from the back wall of the kitchen and above the cooking grates of the cooktop. The air A500 (e.g., A500*a*, A500*b*) impedes the flow of flue gases A132, A134, air A136, and/or other heated air from the cooktop from flowing toward the side of the appliance and/or the kitchen cabinetry located adjacent to the sides of the appliance 100.

Figure 7A:
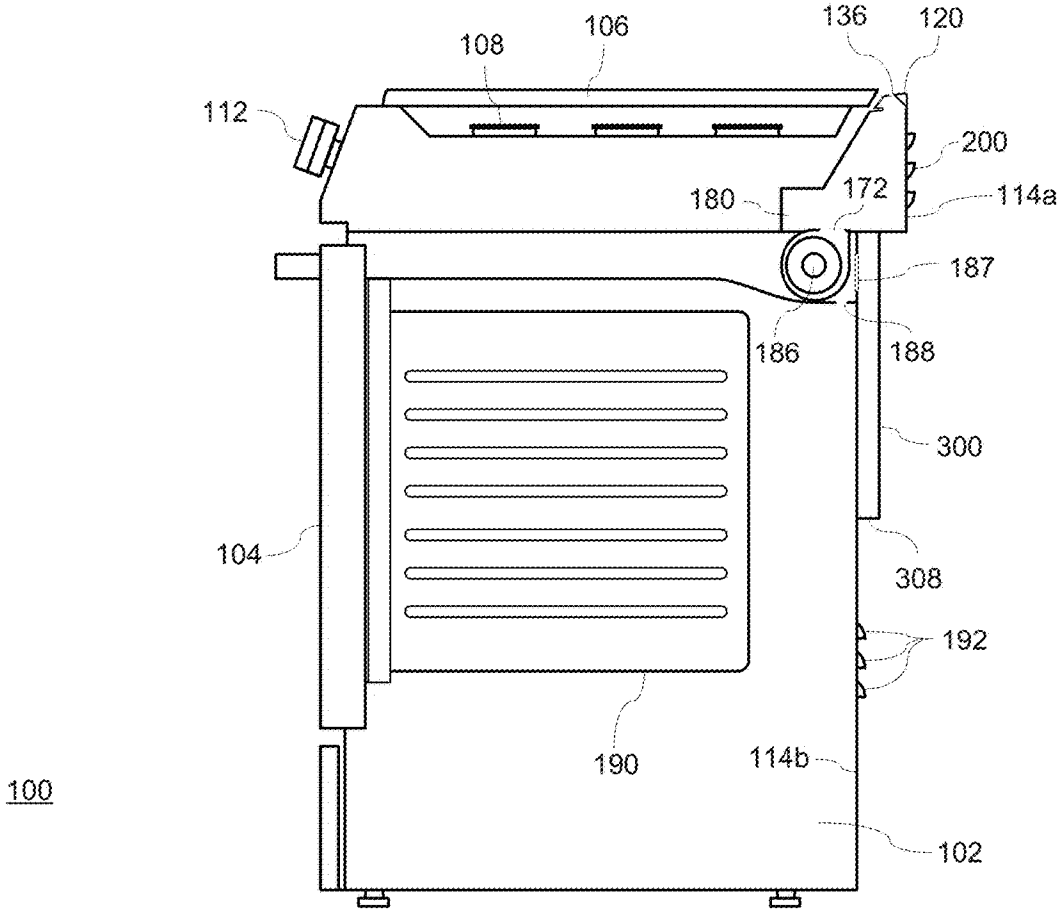
FIG. 7A is a schematic side view of a home cooking appliance according to an exemplary embodiment of the invention.
Figure 7B:
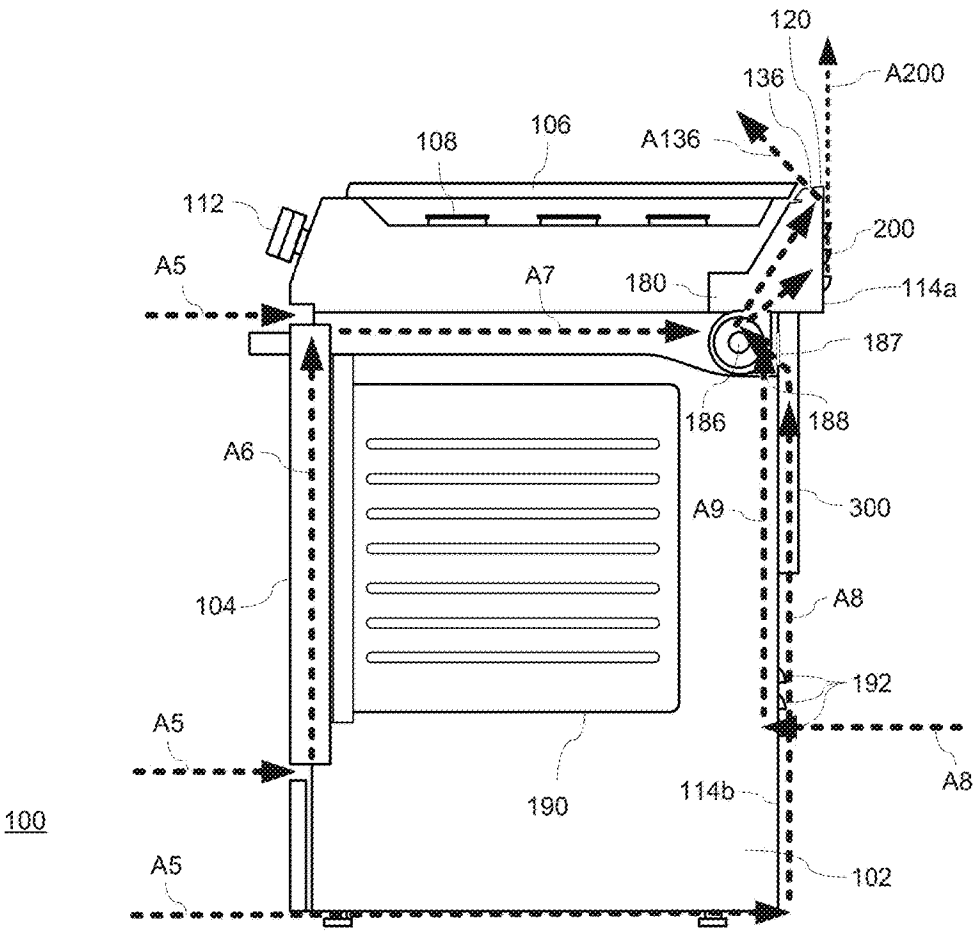
FIG. 7B is a schematic side view of the home cooking appliance according to the exemplary embodiment of the invention in FIG. 7A illustrating air flow paths through the rear vent trim and rear exhaust louvers.
Figure 7C:
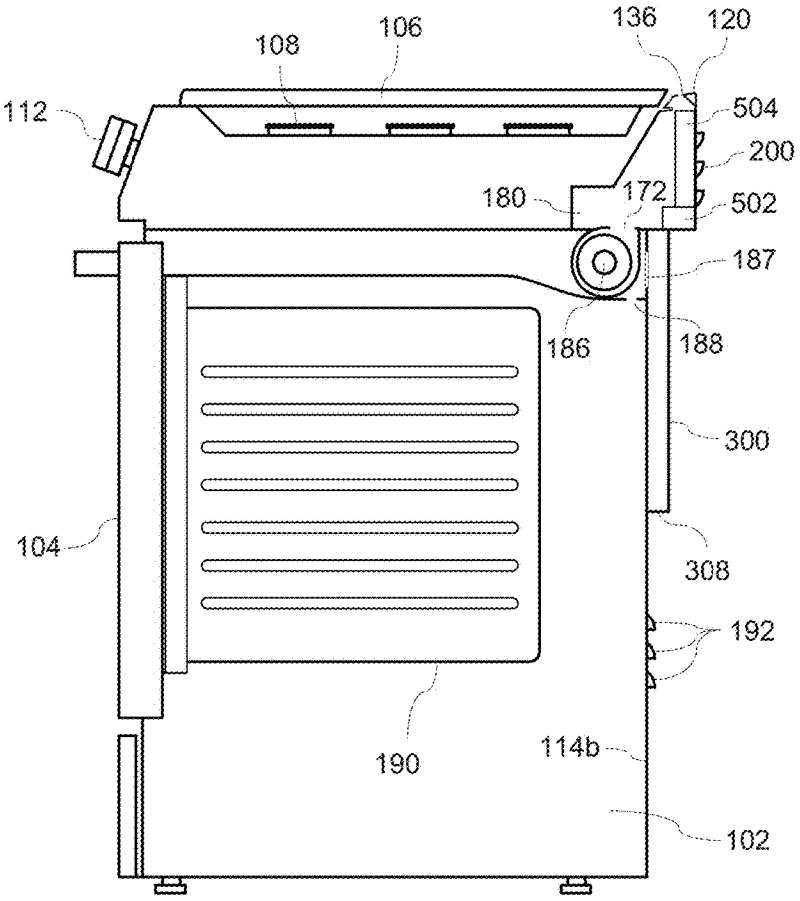
FIG. 7C is a schematic side view of a home cooking appliance having an exhaust channel according to another exemplary embodiment of the invention illustrating air flow paths.
Figure 7D:
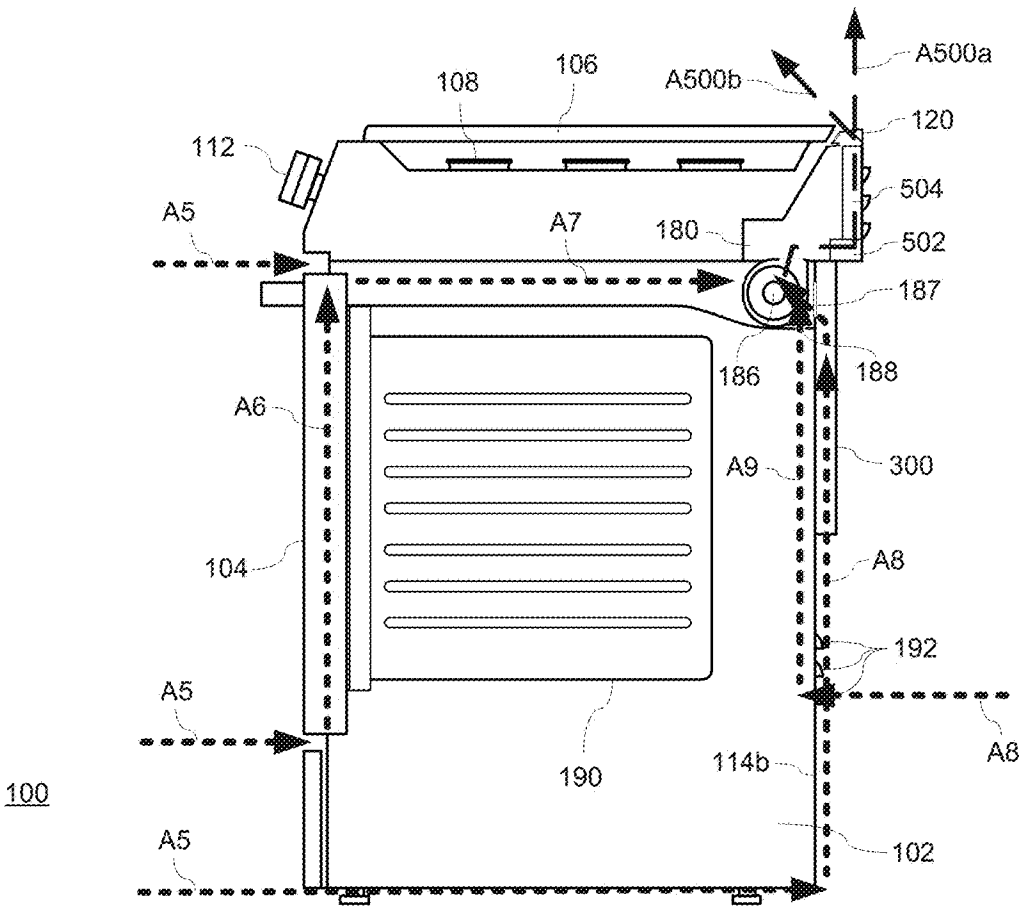
FIG. 7D is a schematic side view of the home cooking appliance having the exhaust channel according to the exemplary embodiment of the invention in FIG. 7C illustrating air flow paths through the exhaust channel only.

FIGS. 7A-7D schematically illustrate a cooling air system and the flow of the cooling air through the cooling air system of an exemplary embodiment of a home cooking appliance having an exhaust channel 504. FIGS. 7A and 7B schematically illustrate a cooling air system and the flow of the cooling air from the cooling air system to the rear exhaust louvers 200 and the rear vent trim 120. FIGS. 7C and 7D schematically illustrate the cooling air system and the flow of the cooling air from the cooling air system to the channels 502, exhaust channels 504, and the rear vent trim 120.

The appliance 100 includes a housing 102 having a cooking compartment 190 accessible through a door 104, cooktop burners 108, and a control panel 110 having a plurality of control knobs 112 for controlling the operation of the burners 108 and the cooking compartment 190. The appliance 100 includes a substantially flush, low-profile rear vent trim 120 arranged at a rear side of the top of the appliance 100. Similar to the embodiment illustrated in FIGS. 6A-6D, the rear vent trim 120 includes openings 136 in fluid communication with a cavity or duct 180 for exhausting a portion of the cooling air circulated or passed through the appliance (e.g., through the housing 102 and/or door 104 of the appliance 100) by a fan 186. The housing 102 includes a first rear wall portion 114*a* having a plurality of rear exhaust louvers 200 in fluid communication with the cavity 180. The housing includes a second rear wall portion 114*b* having a plurality of intake vents 192 in fluid communication with an interior of the housing 102. The intake vents 192 can be positioned at any location on the housing 102, such as adjacent to various electronic components, etc., in order to cool such components.

As shown in FIG. 7B, in operation, the fan 186 draws cool ambient kitchen air A5 into the housing 102 and/or door 104 of the appliance 100. The cooling air flows through the door 104 along flow path A6 and through the housing 102 along flow path A7 such that heat from the cooking compartment 190 and other components of the appliance is transferred to the cooling air and conveyed away in order to cool the cooking compartment and other components of the appliance 100. The fan 186 draws the air through the appliance and then pushes the heated air through the opening 172 into the cavity 180.

The fan 186 produces a high pressure in the cavity 180 that forces a portion of the heated air A136 out of the openings 136 of the rear vent trim 120. The rear vent trim 120 includes one or more deflectors to direct the air A136 exiting the openings 136 away from the back wall of the kitchen (e.g., away from a 90° angle with respect to the upper surface of the cooking surface 106), and more particularly, in a forward direction above the cooking grates 106 of the cooktop such that the air A136 does not disrupt the burner flame even when a burner 108 is on a lowest setting.

The high pressure in the cavity 180 also forces a portion of the heated air A200 out of the rear exhaust louvers 200 of the rear wall 114*a*. The rear exhaust louvers 200 direct the air A200 in an upward direction along the rear wall 114*a* and substantially in a plane of the rear wall 114*a* such that the air A200 flows upward beyond the top of the appliance to increase the air pressure along the back wall of the kitchen and create an air wash that impedes the flow of the air A136 (as well as the flue gases A132, A134 in FIGS. 6A and 6B, and other heated air from the cooktops) from flowing or being drawn toward the back wall of the kitchen.

The cooling air system can exhaust greater than 50% of the cooling air from the cooling air system through the rear exhaust louvers 200 of the appliance 100. That is, the amount of air A200 exiting the louvers 200 can be greater than the amount of air A136 exiting the openings 136 in the rear vent trim 120. In another embodiment, the cooling air system can exhaust less than 50% of the air through the rear exhaust louvers 200 of the appliance 100. That is, the amount of air A200 exiting the louvers 200 can be less than the amount of air A136 exiting the openings 136 in the rear vent trim 120. In yet another embodiment, the cooling air system can exhaust the same amount of air (e.g., 50%) from the rear exhaust louvers 200 of the appliance 100 as the rear vent trim 120. That is, the amount of air A200 exiting the louvers 200 can be substantially equal to the amount of air A136 exiting the openings 136 in the rear vent trim 120.

With reference again to FIGS. 7A-7D, the appliance 100 provides a plurality of hot air extraction points on different locations 120, 200 of the appliance by dividing or separating the air flow from the cooling air system between the rear vent trim 120 (on top of the appliance) and the rear exhaust louvers 200 (on the rear wall of the appliance). The rear exhaust louvers 200 can provide several functions. For example, the rear exhaust louvers 200 direct the air A200 in an upward direction along the rear wall 114*a* and substantially in a plane of the rear wall 114*a* such that the air A200 flows upward beyond the top of the appliance to increase the air pressure along the back wall of the kitchen and create an air wash that impedes the flow of the air A136 (as well as the flue gases A132, A134 in FIGS. 6A and 6B, and other heated air from the cooktops) from flowing or being drawn toward the back wall of the kitchen. The rear exhaust louvers 200 also depressurize the airflow in the cooling air system and direct a portion A200 of the airflow out of the rear wall 114*a* of the appliance 100, thereby increasing the volume of air that can flow through the cooling air system and reducing back pressure in the cavity 180. The rear exhaust louvers 200 can be formed by an opening in the rear wall 114*a* of the appliance 100 that exhausts a portion A200 of the air from the cooling air system in an upward direction. The rear exhaust louvers 200 are not limited to any particular shape, size, or arrangement. The outlet of the rear exhaust louvers 200 can be configured to direct the air A200 upward (e.g., vertically or at an angle) from the outlet along an exterior surface of the rear wall 114*a* of the housing 100. One or more of the rear exhaust louvers 200 may include a deflector, flange, or the like that directs or deflects the air A200 from the outlet along the exterior surface of the rear wall 114*a* of the housing 102. In another example, one or more of the rear exhaust louvers 200 can include a deflector, flange, or the like that directs or deflects the air A200 from the outlet vertically along an exterior surface of the rear wall 114*a* of the housing 102. In yet another example, one or more of the rear exhaust louvers 200 can include a deflector, flange, or the like that directs or deflects the air A200 from the outlet of the rear exhaust louver 200 at an angle other than a vertical direction.

With reference again to FIGS. 7A-7D, the fan 186 also can draw air from other areas of the appliance, such as from areas within the appliance housing 102 that house electronics or other components. For example, the fan 186 can be in fluid communication with internal areas within the housing 102 via an opening 188 to permit heated air A9 to be drawn from these areas and exhausted from the appliance in order to cool other components, such as electronics. In operation, the fan 186 draws kitchen air A8 into the housing 102, for example, through one or more intake vents 192 in the housing 102, which may be located in proximity to electrical components or the like. The air flows along flow path A9 through one or more openings 188 and is forced into the cavity 180 by the fan 186, where it is exhausted via the openings 136 in the rear vent trim 120 and the rear exhaust louvers 200.

As shown in FIGS. 7A-7D, in another exemplary embodiment, the appliance 100 includes a rear fan channel 300 on the rear wall 114*b*. The rear fan channel 300 can include a first end in fluid communication with the kitchen air A8 and a second end in fluid communication with the cooling air system of the appliance. The rear fan channel 300 can be on an exterior surface of the rear wall 114*b* of the housing 102. The rear fan channel 300 can be coupled to the rear wall 114*b* or integrally formed with the rear wall 114*b*. In other embodiments (not shown), the rear fan channel 300 can be disposed inside the housing 102 with respect to the rear wall 114*b* with an inlet of the rear fan channel 300 formed in or on the rear wall 114*b* and open to the exterior of the housing 102. All or a portion of the rear fan channel 300 can extend in a downward direction (e.g., vertically or at an angle) along the rear wall 114*b* of the housing 102.

According to the present invention, one or more of the cross-sectional size, length, direction, and/or angle of the rear fan channel 300, the power and speed of the fan 186, and other features and functions of the air cooling air system can be optimized for the particular cooking appliance 100 to provide passing results on both self-clean testing and all cooktop testing. For example, the rear fan channel 300 can be configured to optimize the intake of the cool air A8 from behind the appliance 100 to more efficiently reduce the temperature of the air in the cooling air system before the air is exhausted from the appliance 100, particularly from the rear exhaust louvers 200, thereby maintaining acceptable temperatures along the back wall of the kitchen. The rear fan channel 300 can be configured to intake cool kitchen air A8 in particular locations, or to avoid an intake air from particular locations, in order to maximize an intake of air from certain areas behind the appliance 100 where low temperatures are normally present, and to minimize or avoid an intake of air from areas where higher temperatures are normally present.

The rear fan channel 300 can be configured, for example, to extend along the rear wall 114*b* of the appliance 100 to intake the air in particular locations and/or from particular directions. The rear fan channel 300 can extend in any direction. For example, the rear fan channel 300 can extend vertically, horizontally (not shown), or at an angle. The rear fan channel 300 also can extend in multiple directions (not shown). The rear fan channel 300 can extend for any distance along the rear wall 114*b*. For example, the rear fan channel 300 can extend only a small portion of the way down the rear wall 114*b*, or not extend at all. In other embodiments, the rear fan channel 300 can extend by various other distances down the rear wall 114*b*, depending on the desired location where the air A8 is to be drawn into the appliance 100.

As shown in FIGS. 7C and 7D, the appliance 100 includes one or more channels or tubes 502, 504 configured to guide a portion of the cooling air to one or more of the rear exhaust louvers 200. For example, the appliance 100 includes one or more channels 502 to guide a portion of the cooling air toward the sides of the appliance and into one or more exhaust channels 504 located at the corners of the appliance such that the air A500*a*, A500*b* can be exhausted from the cooling air system from openings 136 in the rear vent trim 120, which are disposed over the exhaust channels 504 at the corners of the appliance 100 to impede the flow of hot air toward the corners of the appliance. The air exhausting from the exhaust channel 504 can be directed or split into more than one air stream or direction. For example, in the illustrated embodiment, a first portion of the air A500*a* is exhausted in an upward direction to, for example, an opening in the rear vent trim such that the air A500*a* flows in an upward direction from the corners of the appliance. A second portion of the air A500*b* is directed in a forward direction away from the back wall 16 of the kitchen (e.g., away from a 90° angle with respect to the upper surface of the cooking surface 106). The size, shape, and arrangement of the channels 504 can be selected to control or balance an amount of air flowing to the exhaust channels 504 and rear exhaust louvers 200.

With reference to FIGS. 8A-8D, the air flow above the cooktop of an appliance according to the exemplary embodiments of the invention, and the affect on the air flow by various aspects of the exemplary embodiments of the invention, will now be described.

Figure 8A:
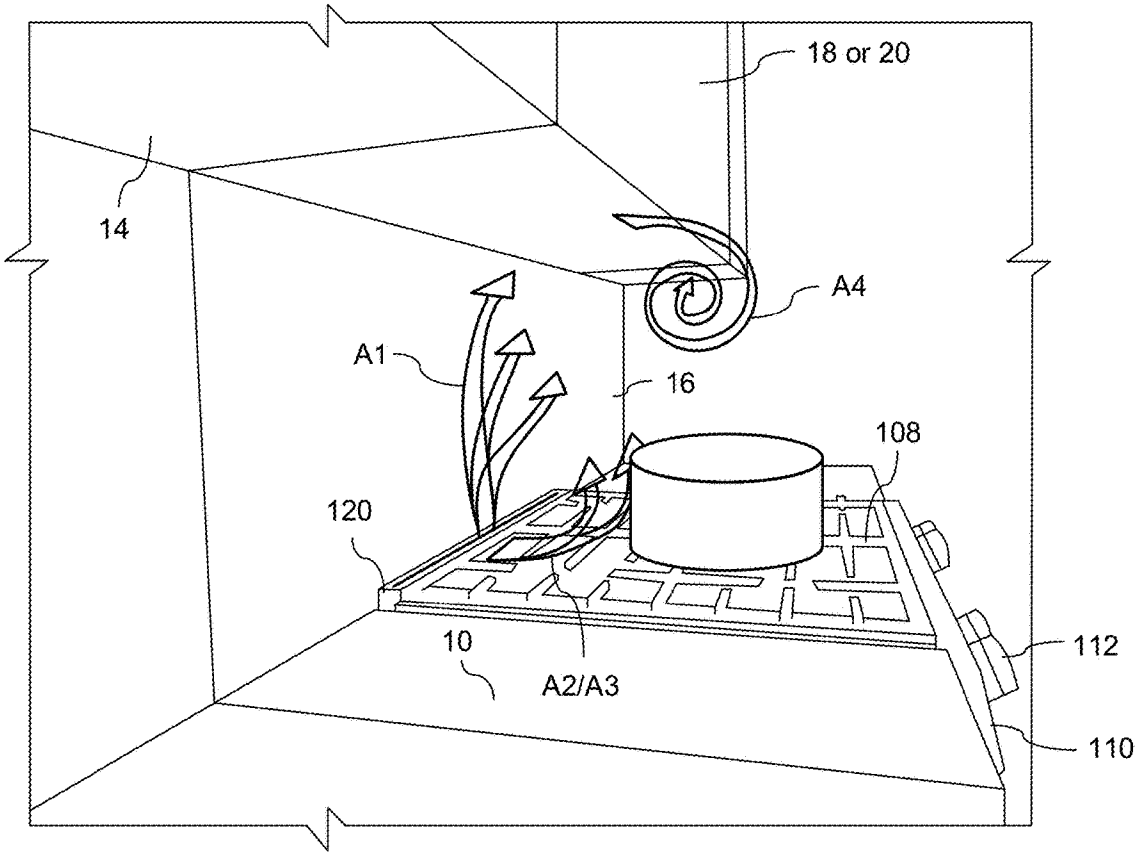
FIG. 8A is a partial, perspective view of a home cooking appliance according to an exemplary embodiment of the invention schematically illustrating air flow patterns.

With reference to FIG. 8A, a home cooking appliance 100 has been provided with a rear vent trim 120 with one or more openings for permitting air to exit from within the rear vent trim 120 while directing the air away from the back wall 16 (e.g., away from a 90° angle with respect to the upper surface of the cooking surface), as illustrated by the arrows A1, A2, and/or A3 in FIG. 8A. The rear vent trim 120 (and particularly the openings in the rear vent trim) can be arranged in fluid communication with a cavity or duct for exhausting kitchen air (e.g., A1) up and away from the back wall 16 of the kitchen, a cavity or duct (e.g., 180 in FIGS. 6A-7C) for exhausting cooling air (e.g., A2) circulated or passed through the appliance (e.g., through the housing 102 and/or door 104 of the appliance 100), and/or one or more flues for exhausting flue gas (e.g., A3) from the cooking compartment. The rear vent trim 120 controls and manages the air flow by directing the flow of air (e.g., A1, A2, A3) from the rear vent trim 120 forward and away from a combustible back wall 16 of the kitchen (e.g., away from a 90° angle with respect to the upper surface of the cooking surface), thereby minimizing temperatures on the combustible back wall 16 of the kitchen and improving compliance with industry standards and regulations. In an exemplary embodiment, the rear vent trim 120 exhausts the air A1, A2, A3 from different openings in the rear vent trim 120 while directing the air A1, A2, A3 away from the back wall 16. The rear vent trim 120 can split the air A1, A2, A3 such that some of the air (e.g., A2, A3 in FIG. 2) flows at an angle away from the back wall 16 and beneath the cooking grates 106, while some of the air (e.g., A1) flows at an angle away from the back wall 16 and above the cooking grates 106.

As shown in FIG. 8A, the rear vent trim 120 is configured to provide three air-flow 'zones' for managing airflow over the cooking surface 106. For example, the rear vent trim 120 includes one or more first openings providing a first zone (Zone 1; shown by A1) in which air comes up from behind the appliance 100, exits the rear vent trim 120 through a first opening or set of openings, and gently blows up and forward to cool the back wall 16. The rear vent trim 120 includes a second opening or set of openings providing a second zone (Zone 2; shown by A2) such that, when the oven is ON and a cooling fan (e.g., 186 shown in FIGS. 7A-7C) is running, air A2 is gently directed out of the second openings at angles away from the burners 108 such that the air A2 does not disrupt the burner flame even when a burner 108 is on a lowest setting. The air A2 from the second zone works in combination with the air A1 from the first zone to gently spin the combined air flow A4 up in a vortex away from the back wall and upper cabinets, for example, like a reverse-Coanda effect. The rear vent trim 120 includes a third opening or set of openings in communication with one or more oven flues (e.g., 156 shown in FIGS. 6A-6B) to provide a third zone (Zone 3; shown by A3) such that hot air/flue gas (oven combustion) flows up from the gas cooking compartment, exits the third openings of the rear vent trim 120 in a direction away from the back wall 16, and gently wisps out onto the cooktop spill tray on the top of the housing 102. The hot air/flue gas A3 of the third zone moves into the airstream A4 created by the first zone A1 and the second zone A2 and away from the back wall 16 and upper cabinets 18 (or components 20 such as an OTR microwave). In a particular example, the rear vent trim 120 directs the air A1 of the first zone away from the back wall 16 and above the cooking grates 106, while directing the both the cooling air A2 and the hot air/flue gas A3 of the second zone and the third zone away from the back wall 16 and beneath the cooking grates 106. Alternatively, the rear vent trim 120 can direct the air A1 of the first zone and the cooling air A2 away from the back wall 16 and above the cooking grates 106, and the hot air/flue gas A3 of the third zone away from the back wall 16 and beneath the cooking grates 106.

The present invention recognizes that the three air zones A1, A2, and A3 may not prevent some of the hot air from flowing toward the back wall 16 or from cycling against the back wall 16 of the kitchen in some circumstances or under some operating conditions. For example, under some testing conditions for determining compliance with industry standards, all burners are turned on (e.g., at 80%) and the oven compartment is operating at a high-temperature (e.g., 475°) over a long period of time. Under these conditions, some hot air may continue to be drawn toward the back wall 16 or cycle behind the air zones A1, A2, and A3 toward the back wall 16 of the kitchen, thereby increasing a risk of exceeding acceptable testing temperatures for the back wall 16 of the kitchen. Moreover, since the test is conducted over a long period of time, the air flow around the appliance may be influenced, for example, by other motion in the kitchen area, such as by a user walking through the room, which may result in the air zones A1, A2, and A3 not being sufficient to prevent hot air from flowing toward the back wall 16 of the kitchen.

The exemplary embodiments of the invention can impede the flow of hot air toward the back wall 16 and/or impede the cycling of the hot behind the air zones A1, A2, and A3 toward the back wall 16 of the kitchen under various operating conditions.

For example, the exemplary home cooking appliance 100 includes a substantially flush rear vent trim 120 along with one or more rear exhaust louvers 200 that direct the air A200 in an upward direction along the rear wall 114*a* and substantially in a plane of the rear wall 114*a* such that the air A200 flows upward beyond the top of the appliance to increase the air pressure along the back wall 16 of the kitchen and creates an air wash that impedes the flow of the air A136, flue gases A132, A134, and other heated air A108 from the cooktops from flowing or being drawn toward the back wall 16 of the kitchen.

Figure 8B:
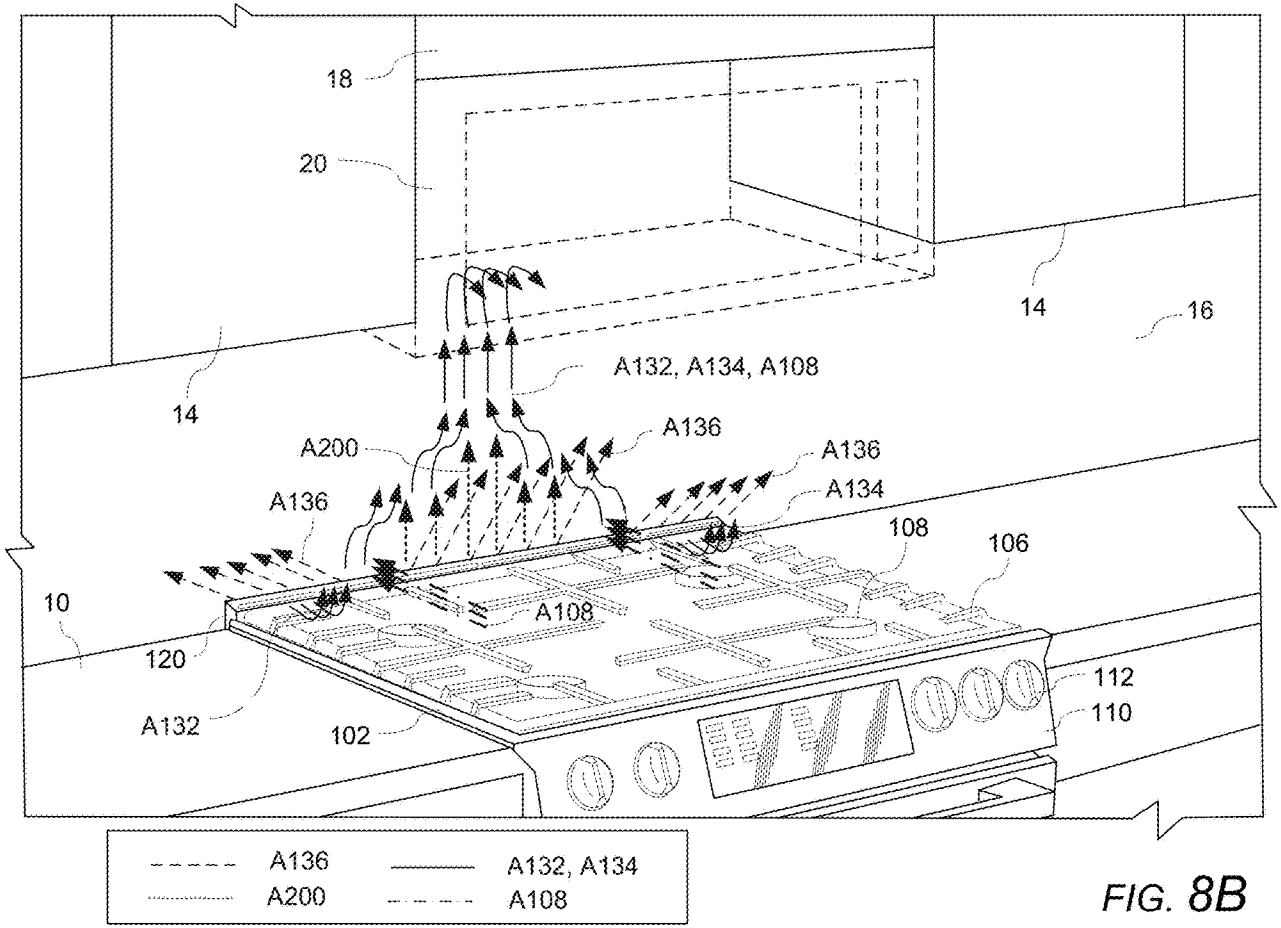
FIG. 8B is a partial, perspective view of a home cooking appliance according to an exemplary embodiment of the invention schematically illustrating air flow patterns.

For example, FIG. 8B illustrates an exemplary embodiment of a home cooking appliance 100 having a plurality of rear exhaust louvers 200 located, for example, in a central position with respect to the width of the appliance 100 and a substantially flush rear vent trim 120 that directs air A136 from the cooling air system forward and away from the back wall of the kitchen (e.g., away from a 90° angle with respect to the upper surface of the cooking surface 106), and more particularly, in a forward direction above the cooking grates 106 of the cooktop such that the air A136 does not disrupt the burner flame even when a burner 108 is on a lowest setting. The plurality of rear exhaust louvers 200 direct the air A200 in an upward direction along the rear wall 114*a* and substantially in a plane of the rear wall 114*a* such that the air A200 flows upward beyond the top of the appliance to increase the air pressure along the back wall 16 of the kitchen and creates an air wash that impedes the flow of the air A136, flue gases A132, A134, and other heated air A108 from the cooktops from flowing or being drawn toward the back wall 16 of the kitchen. The air A200 being directed by the plurality of rear exhaust louvers 200 in an upward direction along the rear wall 114*a* and substantially in a plane of the rear wall 114*a* is cooled prior to being exhausted from the rear exhaust louvers 200 by mixing the cooling air in the cooling air system with cooler air (e.g., A8 in FIGS. 7A-7D) drawn in from behind the appliance 100 by one or more fan channels (e.g., 300 in FIGS. 7A-7D), thereby maintaining acceptable temperatures along the back wall 16 of the kitchen. Additionally, a temperature of the air A136 being exhausted from the openings 136 in the rear vent trim 120 also can be reduced, which also may reduce air temperatures above the cooktop 106 of the appliance 100. As shown in FIG. 8B, during some scenarios of operation, this embodiment may still draw some hot air (e.g., a combination of hot air from A132, A134, and/or A108) around behind the air A200 and A136 from the cooling air system and up the back wall 16 to the cabinets 18, 20.

Figure 8C:
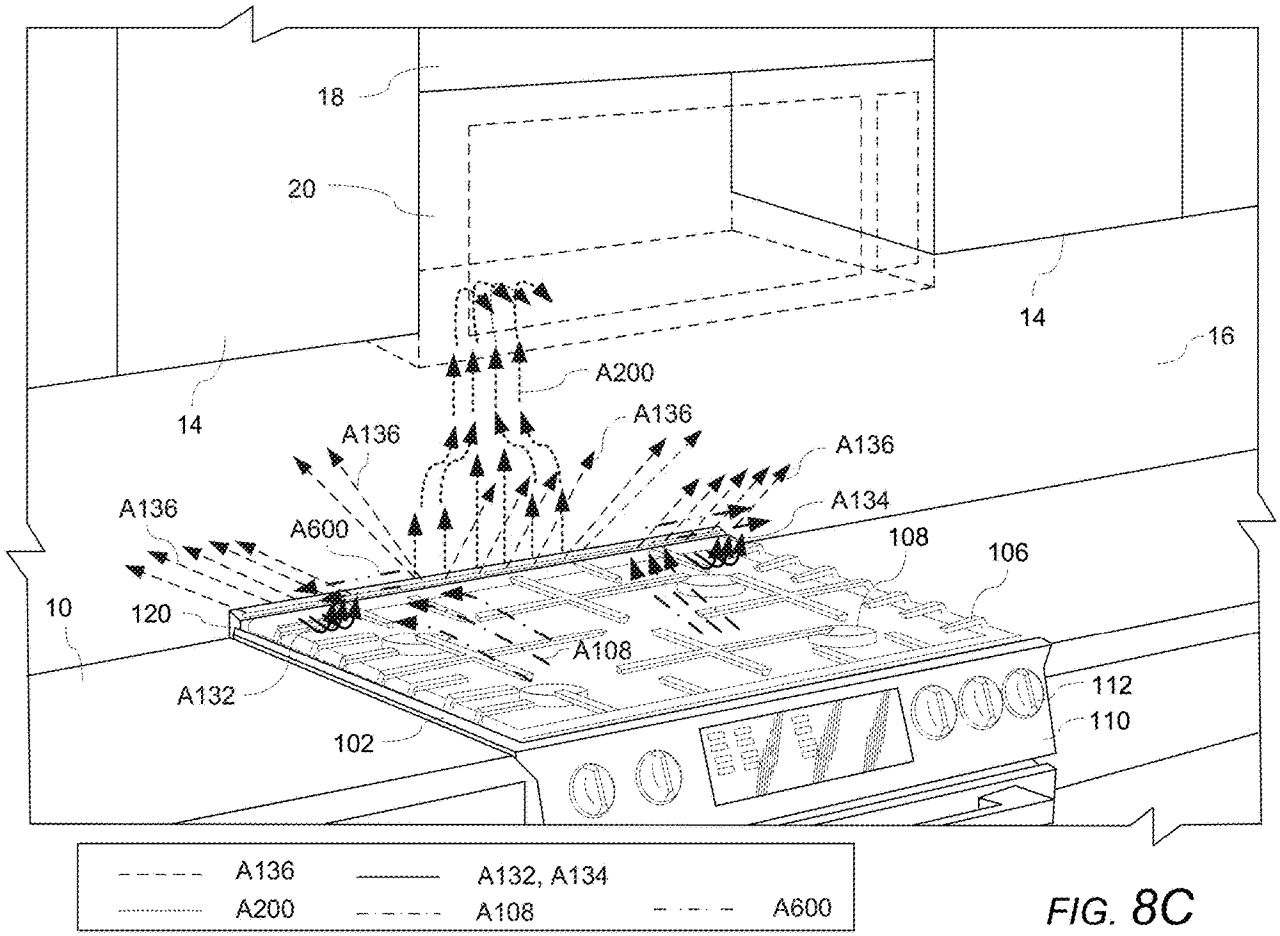
FIG. 8C is a partial, perspective view of a home cooking appliance according to an exemplary embodiment of the invention schematically illustrating air flow patterns.

FIG. 8C illustrates another exemplary embodiment of a home cooking appliance 100 having a plurality of rear exhaust louvers 200 located, for example, in a central position with respect to the width of the appliance 100 and a substantially flush rear vent trim 120 that directs air A136 from the cooling air system forward and away from the back wall of the kitchen (e.g., away from a 90° angle with respect to the upper surface of the cooking surface 106), and more particularly, in a forward direction above the cooking grates 106 of the cooktop such that the air A136 does not disrupt the burner flame even when a burner 108 is on a lowest setting. As with the embodiment in FIG. 8B, the plurality of rear exhaust louvers 200 direct the air A200 in an upward direction along the rear wall 114*a* and substantially in a plane of the rear wall 114*a* such that the air A200 flows upward beyond the top of the appliance to increase the air pressure along the back wall 16 of the kitchen and creates an air wash that impedes the flow of the air A136, flue gases A132, A134, and other heated air A108 from the cooktops from flowing or being drawn toward the back wall 16 of the kitchen. In this embodiment, the openings 136 in the substantially flush rear vent trim 120 are configured to exhaust a greater amount of air A136 along the length of the rear vent trim 120, and particularly, a greater amount of air A136 to the sides of the rear vent trim 120. According to the present invention, the air A200 being directed by the plurality of rear exhaust louvers 200 in an upward direction along the rear wall 114*a* and substantially in a plane of the rear wall 114*a* is cooled prior to being exhausted from the rear exhaust louvers 200 by mixing the cooling air in the cooling air system with cooler air (e.g., A8 in FIGS. 7A-7D) drawn in from behind the appliance 100 by one or more fan channels (e.g., 300 in FIGS. 7A-7D), thereby maintaining acceptable temperatures along the back wall 16 of the kitchen. Additionally, a temperature of the air A136 being exhausted from the openings 136 in the rear vent trim 120 also can be reduced, which also may reduce air temperatures above the cooktop 106 of the appliance 100. As shown in FIG. 8C, during some scenarios of operation, this embodiment may still push some hot air A600 (e.g., a combination of hot air from A132, A134, and/or A108) toward the sides of the rear vent trim and adjacent cabinetry (e.g., 10, 14), and then up the back wall 16 adjacent to the sides of the appliance.

Figure 8D:
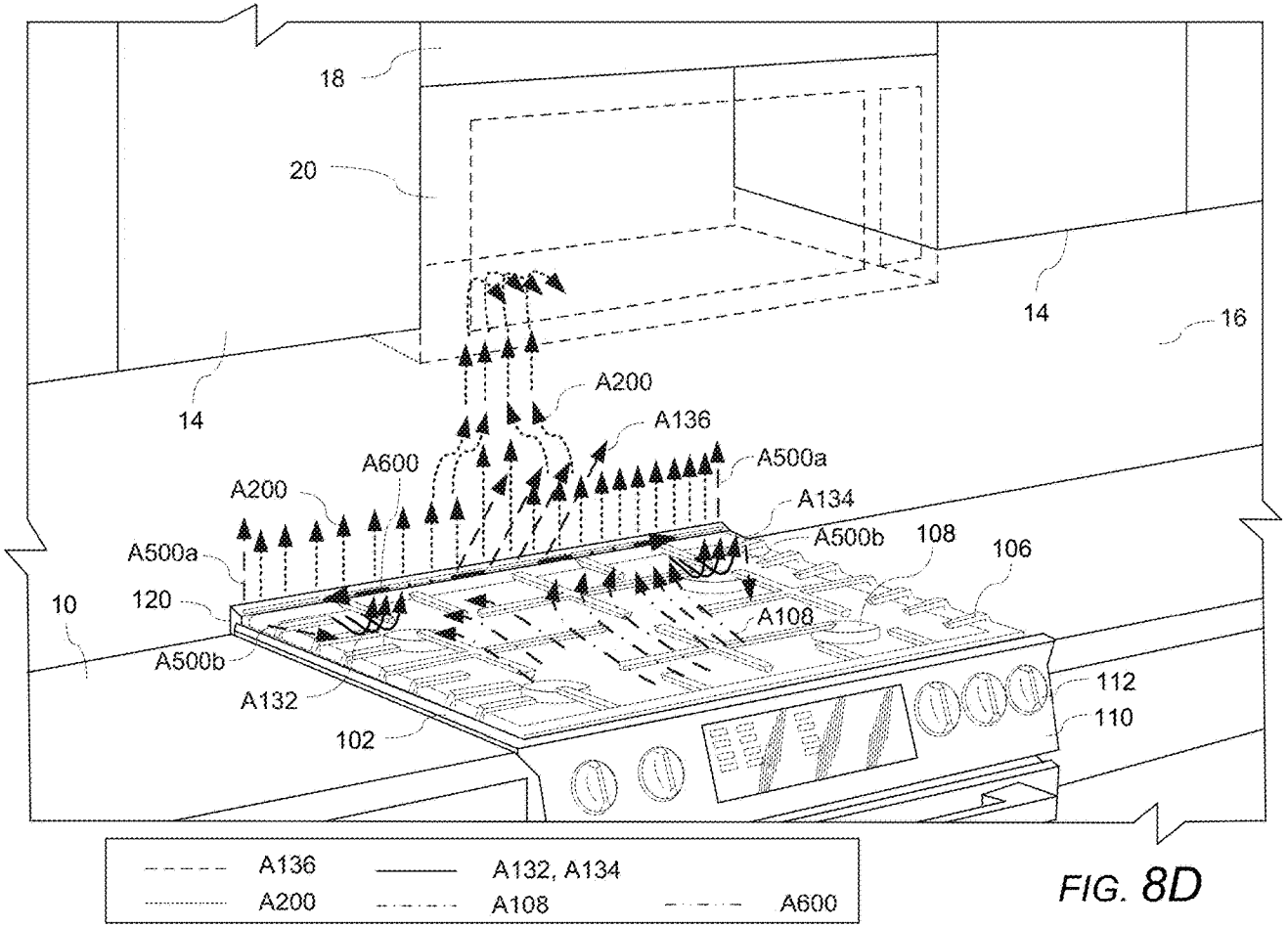
FIG. 8D is a partial, perspective view of a home cooking appliance according to an exemplary embodiment of the invention schematically illustrating air flow patterns.

FIG. 8D illustrates another exemplary embodiment of a home cooking appliance 100 having a plurality of rear exhaust louvers 200 located, for example, across the width of the appliance 100 and a substantially flush rear vent trim 120 that directs air A136 from the cooling air system forward and away from the back wall 16 of the kitchen (e.g., away from a 90° angle with respect to the upper surface of the cooking surface 106), and more particularly, in a forward direction above the cooking grates 106 of the cooktop such that the air A136 does not disrupt the burner flame even when a burner 108 is on a lowest setting. As with the embodiment in FIGS. 8B and 8C, the plurality of rear exhaust louvers 200 direct the air A200 in an upward direction along the rear wall 114*a* and substantially in a plane of the rear wall 114*a* such that the air A200 flows upward beyond the top of the appliance to increase the air pressure along the back wall 16 of the kitchen and creates an air wash that impedes the flow of the air A136, flue gases A132, A134, and other heated air A108 from the cooktops from flowing or being drawn toward the back wall 16 of the kitchen.

In the exemplary embodiment of FIG. 8D, the rear exhaust louvers 200 extend across the entire width of the appliance 100, thereby creating a high pressure air wash by the air A200 that extends across the entire width of the appliance 100 along the back wall 16 of the kitchen. Moreover, the appliance 100 includes exhaust channels 504 that exhaust air A500*a*, A500*b* from the cooling air system from the openings at the corners of the rear vent trim 120. In this embodiment, the air A500*a* is exhausted in an upward direction from the corners of the rear vent trim 120 and the air A500*b* is exhausted in a forward direction away from the back wall 16 of the kitchen (e.g., away from a 90° angle with respect to the upper surface of the cooking surface 106), thereby creating a high pressure area or air stream by the air A500*a*, A500*b* at each corner of the appliance 100 to impede the flow of hot air toward the corners of the appliance. Furthermore, the openings 136 in the substantially flush rear vent trim 120 are configured to exhaust air A136 along a central portion of the rear vent trim 120 to push the hot air from the flues A132, A134 and cooktop A108 (which is impeded from flowing toward the back wall 16 and the sides of the appliance by the air A200 and corner exhaust air A500*a*, A500*b*) forward and away from the back wall 16 of the kitchen.

As shown in FIG. 8D, this exemplary embodiment may impede a flow of most, or all, of the hot air toward the back wall 16 and toward the sides of the rear vent trim and adjacent cabinetry (e.g., 10, 14), such that the air A136 from the openings 136 in the substantially flush rear vent trim 120 is sufficient to push the hot air from the flues A132, A134 and cooktop A108 forward and away from the back wall 16 of the kitchen and the corners of the appliance 100, thereby reducing temperatures on the back wall 16 and adjacent cabinetry 14, 18, 20 during operation of the appliance 100. As a result, the present invention can provide an appliance having a substantially flush rear vent trim while providing sufficient control of the air flow around the appliance to comply with industry standards and requirements. The air A200 being directed by the plurality of rear exhaust louvers 200 in an upward direction along the rear wall 114*a* and substantially in a plane of the rear wall 114*a* is cooled prior to being exhausted from the rear exhaust louvers 200 by mixing the cooling air in the cooling air system with cooler air (e.g., A8 in FIGS. 7A-7D) drawn in from behind the appliance 100 by one or more fan channels (e.g., 300 in FIGS. 7A-7D), thereby maintaining acceptable temperatures along the back wall 16 of the kitchen. Additionally, a temperature of the air A136 being exhausted from the openings 136 in the rear vent trim 120 also can be reduced, which also may reduce air temperatures above the cooktop 106 of the appliance 100.

FIGS. 9A-10B schematically illustrate test results showing measured surface temperatures at a rear wall 114 of an appliance 100 having various exemplary arrangements and optimizations of rear exhaust louvers 200 and other components, such as the rear fan channels 300 and exhaust channels 504.

Figure 9A:
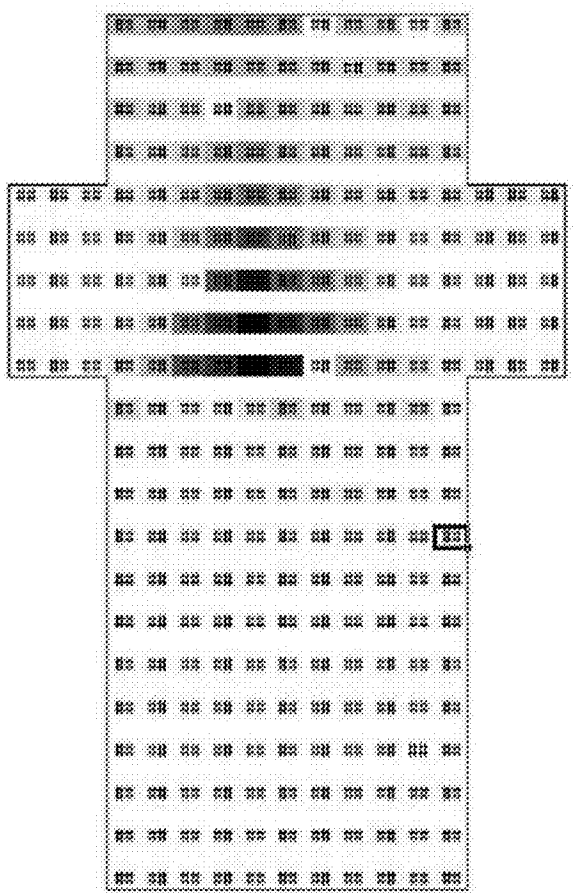
FIG. 9A is a schematic view illustrating test results of measured surface temperatures at a rear wall of an appliance without fan channels.
Figure 9B:
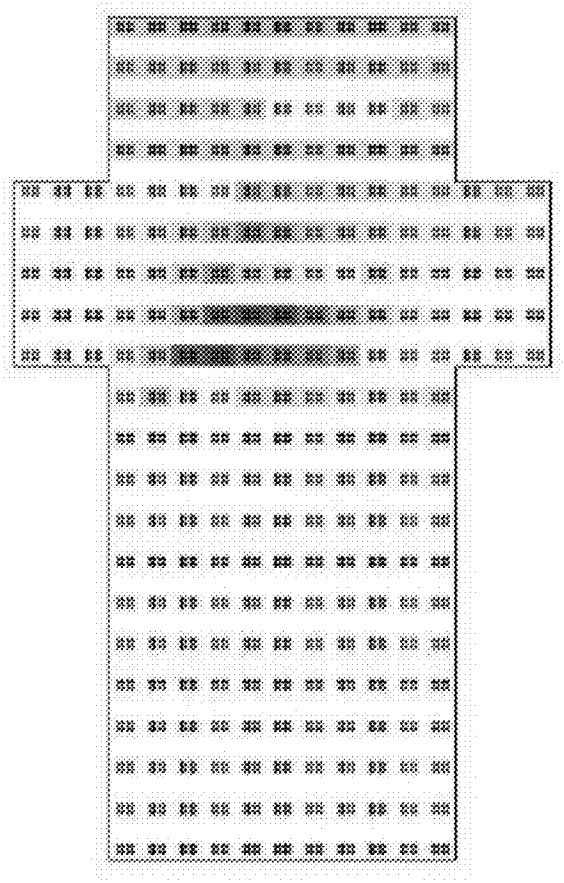
FIG. 9B is a schematic view illustrating test results of measured surface temperatures at a rear wall of an appliance having fan channels according to an exemplary embodiment of the invention.

For example, FIG. 9A schematically illustrates test results showing measured surface temperatures at a rear wall of an appliance having a rear vent trim 120 without the rear exhaust louvers 200 or rear fan channels 300. FIG. 9B schematically illustrates test results showing measured surface temperatures at a rear wall 114 of an appliance 100 having a substantially flush rear vent trim 120, rear exhaust louvers 200, and rear fan channels 300 after balancing the air flow through the substantially flush rear vent trim 120, rear exhaust louvers 200, and rear fan channels 300. As evident from a comparison of FIGS. 9A and 9B, the rear exhaust louvers 200 were able to increase the pressure along the back wall of the kitchen to impede a flow of hot air from the rear vent trim 120 and cooktop toward the back wall, thereby enabling sufficient air flow from the substantially flush rear vent trim 120 to direct cooktop heat forward without causing an unacceptable amount of heat to be drawn against the back wall of the kitchen. The rear fan channels 300 also were able to maintain acceptable temperatures of the air flowing from the rear exhaust louvers 200 onto the back wall of the kitchen. Additionally, the substantially flush rear vent trim 120, rear exhaust louvers 200, and rear fan channels 300 were able to provide sufficient air flow through the cooling air system of the appliance 100 to maintain surface temperatures, for example at the oven door 104, and to protect all other components (e.g., electrical components) without causing an unacceptable amount of heat to flow or be drawn against the back wall of the kitchen.

Figure 10A:
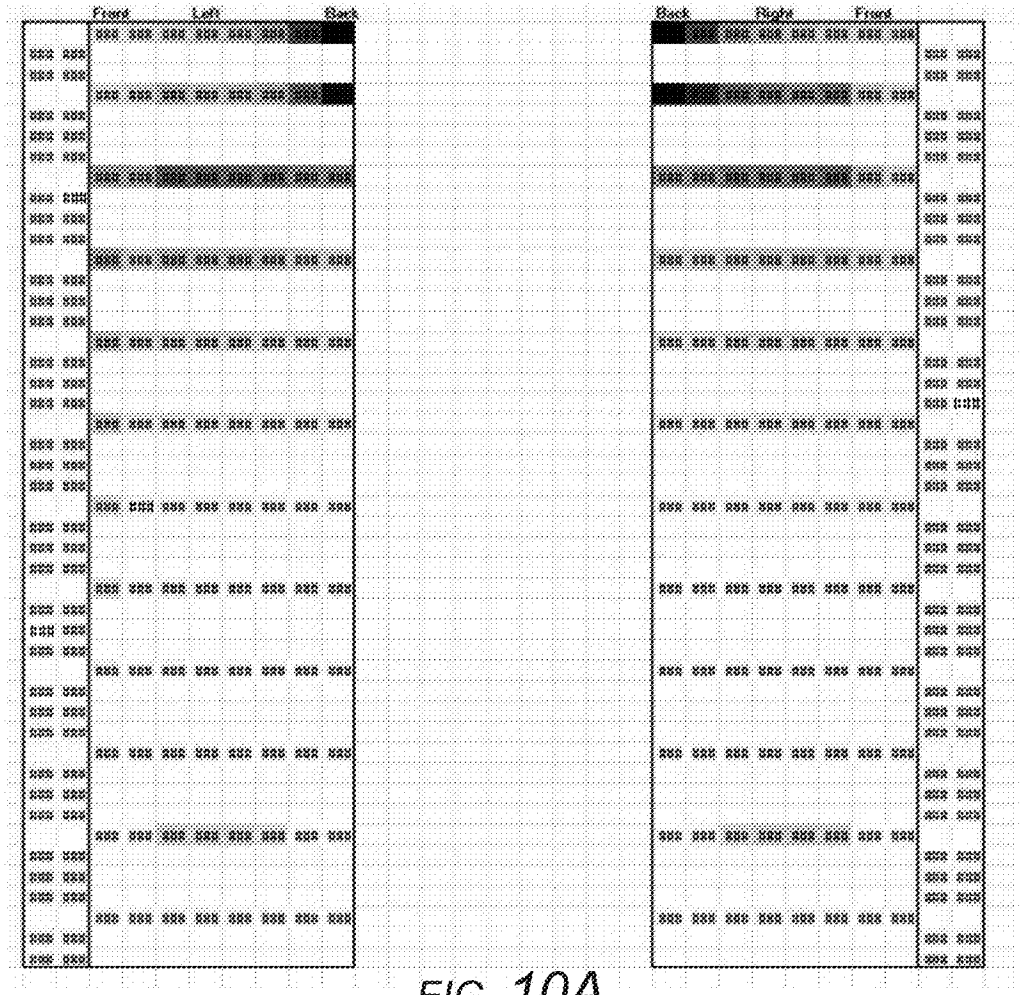
FIG. 10A is a schematic view illustrating test results of measured surface temperatures at a rear wall of an appliance having fan channels according to an exemplary embodiment of the invention without exhaust channels.
Figure 10B:
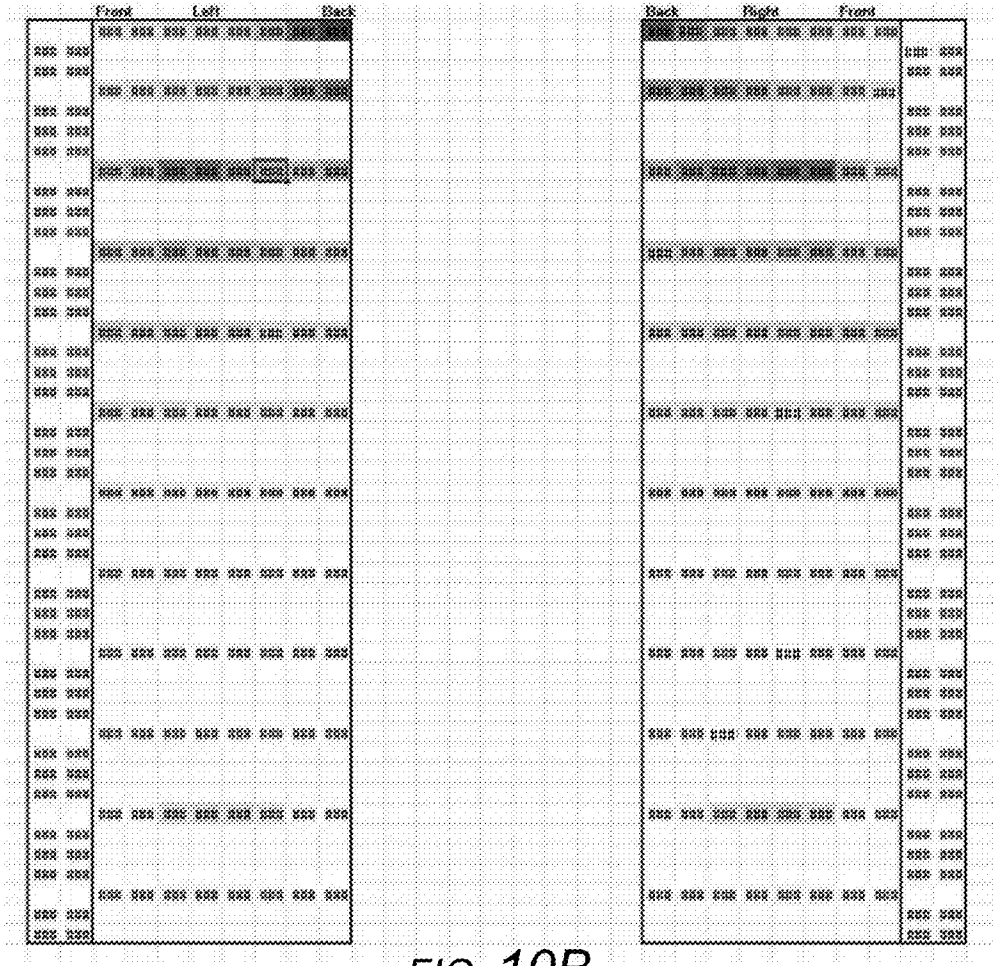
FIG. 10B is a schematic view illustrating test results of measured surface temperatures at a rear wall of an appliance having fan channels and exhaust channels according to an exemplary embodiment of the invention.

For example, FIG. 10A schematically illustrates test results showing measured surface temperatures at a rear wall of an appliance having a substantially flush rear vent trim 120 and rear exhaust louvers 200 without exhaust channels 504. FIG. 10B schematically illustrates test results showing measured surface temperatures at a rear wall 114 of an appliance 100 having a substantially flush rear vent trim 120, rear exhaust louvers 200, rear fan channels 300, and exhaust channels 504. As evident from a comparison of FIGS. 10A and 10B, the rear exhaust louvers 200 were able to increase the pressure along the back wall of the kitchen to impede a flow of hot air from the rear vent trim 120 and cooktop toward the back wall, thereby enabling sufficient air flow from the substantially flush rear vent trim 120 to direct cooktop heat forward without causing an unacceptable amount of heat to be drawn against the back wall of the kitchen. The rear fan channels 300 also were able to maintain acceptable temperatures of the air flowing from the rear exhaust louvers 200 onto the back wall of the kitchen. The exhaust channels 504 were able to increase the pressure at the rear corners of the appliance 100 to impede a flow of hot air toward the sides of the appliance 100 or toward the adjacent cabinetry at the sides of the appliance 100, thereby maintaining acceptable temperatures on the adjacent cabinetry in the kitchen. Additionally, the substantially flush rear vent trim 120, rear exhaust louvers 200, rear fan channels 300, and exhaust channels 504 were able to provide sufficient air flow through the cooling air system of the appliance 100 to maintain surface temperatures, for example at the oven door 104, and to protect all other components (e.g., electrical components) without causing an unacceptable amount of heat to flow or be drawn against the back wall of the kitchen.

Other advantages of the exemplary exhaust channels 504, and particularly in combination with the rear vent trim 120 and the rear exhaust louver 200, are that these exemplary arrangements do not blow hot air at a user, allow the burners to function effectively even at lowest settings (without nuisance clicking), allow installation of the appliance with an OTR component (such as an OTR microwave), allow installation of the appliance with a combustible rear wall, and maintain safe door temperatures and electronic component temperatures, even during self clean cycles, particularly when used in combination with other temperature control measures of the exemplary home cooking appliance. By effectively managing and controlling the flow of hot air (e.g., flue gas, cooling air, etc.), the exemplary appliance 100 having exhaust channels 504, rear exhaust louvers 200, and a rear vent trim 120 can assist with balancing and optimizing the air flow in the cooling air system, thereby resulting in improved air flow in and around the appliance, which also results in improved baking results for the oven. Moreover, by effectively managing and controlling the flow of hot air, the exemplary appliance having exhaust channels 504, rear exhaust louvers 200, and a rear vent trim 120 enables the use of a low-profile rear vent trim having a flush installation with the cooking surface to be used, for example, with a high power cooktop (e.g., 60000 BTU/Hr) having, for example five (5) burners, while complying with industry standards and regulations.

With reference again to FIGS. 1-10B, an exemplary embodiment is directed to a home cooking appliance (e.g., 100) comprising a housing (e.g., 102), a cooking surface (e.g., 106) on a top of the housing (e.g., 102); a cooking compartment (e.g., 190) in the housing (e.g., 102); a cooling air system (e.g., 180) conveying air (e.g., flow paths of A1, A2, A3, A5, A7, A8, A9) through the housing (e.g., 102); and an exhaust channel (e.g., 504) in fluid communication with the cooling air system, the exhaust channel (e.g., 504) disposed at a rear corner of the housing (e.g., 102) and exhausting a portion (e.g., A500*a*) of the cooling air in an upward direction from the rear corner of the housing (e.g., 102).

An exemplary embodiment can include a rear exhaust louver (e.g., 200) on the housing (e.g., 102), the rear exhaust louver (e.g., 200) in fluid communication with the cooling air system and exhausting a portion of the air (e.g., A200) from the housing (e.g., 102) in an upward direction substantially in a plane of the rear wall (e.g., 114, 114*a*, 114*b*) of the housing (e.g., 102) to increase air pressure along a kitchen wall (e.g., 16) adjacent to the rear wall (e.g., 114, 114*a*, 114*b*) of the appliance. In another exemplary embodiment, the home cooking appliance (e.g., 100) further comprises a rear vent trim (e.g., 120) on the top of the housing (e.g., 102) and at a rear side of the top of the housing (e.g., 102), the rear vent trim (e.g., 120) having an upper surface that is substantially flush with the upper surface (e.g., 106*a*) of the cooking surface (e.g., 106), the rear vent trim (e.g., 120) including an opening (e.g., 136) permitting additional air to exit from the housing (e.g., 102) from the rear vent trim (e.g., 120), and the rear vent trim (e.g., 120) directing the additional air away from a 90° angle with respect to the upper surface (e.g., 106*a*) of the cooking surface (e.g., 106).

With reference again to FIGS. 1-10B, another exemplary embodiment is directed to a home cooking appliance (e.g., 100) comprising a housing (e.g., 102), a cooking surface (e.g., 106) on a top of the housing (e.g., 102); a cooking compartment (e.g., 190) in the housing (e.g., 102); a cooling air system (e.g., 180) conveying air (e.g., flow paths of A1, A2, A3, A5, A7, A8, A9) through the housing (e.g., 102); and means (e.g., 504) for exhausting a portion (e.g., A500*a*) of the cooling air in an upward direction from the rear corner of the housing (e.g., 102).

In another exemplary embodiment, the home cooking appliance (e.g., 100) further comprises second means (e.g., 200) for exhausting a portion of the air (e.g., A200) from the housing (e.g., 102) in an upward direction substantially in a plane of the rear wall (e.g., 114, 114*a*, 114*b*) of the housing (e.g., 102) and for increasing air pressure along a kitchen wall (e.g., 16) adjacent to the rear wall (e.g., 114, 114*a*, 114*b*) of the appliance (e.g., 100). In another exemplary embodiment, the home cooking appliance (e.g., 100) further comprises third means (e.g., 120) for exhausting a second portion of the air (e.g., A136) from the cooling air system from a top of the housing e.g., 102).

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A home cooking appliance comprising:

a housing;

a cooking surface on top of the housing, the cooking surface having an upper surface;

a cooking compartment in the housing;

a flue exhaust outlet on the housing and in fluid communication with a flue of the cooking compartment, the flue exhaust outlet exhausting flue gases from the cooking compartment from the top of the housing;

a cooling air system that conveys cooling air through the housing;

an exhaust outlet disposed at each rear corner of the housing, each rear corner being along a rear edge of the housing and a rear end of a side edge of the housing; and at least one exhaust channel in fluid communication with the cooling air system and the exhaust outlet at each rear corner, the at least one exhaust channel exhausting a first stream of the cooling air in an upward direction from the exhaust outlet at each rear corner of the housing into a space above each rear corner of the housing and impeding a flow of the exhausted flue gases toward the side edges of the housing and directing the exhausted flue gases inward away from the side edges of the housing while maintaining acceptable temperatures at a kitchen wall adjacent to a rear wall of the housing.

2. The home cooking appliance of claim 1, wherein the at least one exhaust channel exhausts the first stream of the cooling air from the exhaust outlet at each rear corner in a vertical direction with respect to the upper surface of the cooking surface, and wherein the at least one exhaust channel exhausts a second stream of the cooling air from the exhaust outlet at each rear corner of the housing in a forward direction away from a 90° angle with respect to the upper surface of the cooking surface.

3. The home cooking appliance of claim 1, further comprising:

a channel having a first end in fluid communication with the cooling air system and a second end in fluid communication with the at least one exhaust channel, the channel for guiding a first portion of the cooling air from the cooling air system to the at least one exhaust channel.

4. The home cooking appliance of claim 3, wherein the at least one exhaust channel includes a first exhaust channel having:

a first end coupled to the second end of the channel; and a second, open end for exhausting the first stream of the cooling air in the upward direction from one of the rear corners of the housing.

5. The home cooking appliance of claim 4, wherein the first exhaust channel extends in a vertical direction at the one of the rear corners of the housing.

6. The home cooking appliance of claim 1, wherein the at least one exhaust channel includes a first exhaust channel and a second exhaust channel in fluid communication with the cooling air system, the first exhaust channel disposed at a first rear corner of the housing, and the second exhaust channel disposed at a second rear corner of the housing, which is opposite the first rear corner, the first exhaust channel exhausting a first portion of the first stream of the cooling air in the upward direction from the first rear corner of the housing and the second exhaust channel exhausting a second portion of the first stream of the cooling air in the upward direction from the second rear corner of the housing.

7. The home cooking appliance of claim 2, further comprising:

a deflector at each rear corner of the housing that directs the second stream of the cooling air from the exhaust outlet at each rear corner of the housing in the forward direction away from the 90° angle with respect to the upper surface of the cooking surface.

8. The home cooking appliance of claim 1, further comprising:

a rear exhaust louver on the housing, the rear exhaust louver in fluid communication with the cooling air system and exhausting a portion of the cooling air from the cooling air system in an upward direction substantially in a plane of the rear wall of the housing to increase air pressure along the kitchen wall adjacent to the rear wall of the housing of the appliance.

9. The home cooking appliance of claim 8, further comprising:

a fan channel in fluid communication with the cooling air system, the fan channel having an inlet that takes in outside air from along the rear wall of the housing into the cooling air system to reduce a temperature of the cooling air prior to being exhausted from the housing, wherein the portion of the cooling air exhausted from the housing includes a portion of outside air taken into the cooling air system from along the rear wall of the housing by the fan channel.

10. The home cooking appliance of claim 1, further comprising:

a plurality of rear exhaust louvers on the housing, the plurality of rear exhaust louvers in fluid communication with the cooling air system and exhausting a portion of the cooling air from the cooling air system in an upward direction substantially in a plane of the rear wall of the housing to increase air pressure along the kitchen wall adjacent to the rear wall of the appliance.

11. The home cooking appliance of claim 10, further comprising:

a fan channel in fluid communication with the cooling air system, the fan channel having an inlet that takes in outside air from along the rear wall of the housing into the cooling air system to reduce a temperature of the cooling air prior to being exhausted from the housing, wherein the portion of the cooling air exhausted from the housing includes a portion of outside air taken into the cooling air system from along the rear wall of the housing by the fan channel.

12. The home cooking appliance of claim 10, wherein the plurality of rear exhaust louvers are disposed in a central region across a width of the rear wall of the housing.

13. The home cooking appliance of claim 10, wherein the plurality of rear exhaust louvers are arranged in a spaced manner across a width of the rear wall of the housing.

14. The home cooking appliance of claim 13, further comprising:

a channel having a first end in fluid communication with the cooling air system and a second end in fluid communication with the exhaust channel, the channel for guiding the cooling air from the cooling air system to the exhaust channel, wherein at least one rear exhaust louver of the plurality of rear exhaust louvers is in fluid communication with at least a portion of the channel.

15. The home cooking appliance of claim 1, further comprising:

a rear vent trim on the top of the housing and at the rear edge of the top of the housing, the rear vent trim having an upper surface that is substantially flush with the upper surface of the cooking surface, the rear vent trim including an opening permitting additional air to exit from the housing from the rear vent trim, and the rear vent trim directing the additional air away from a 90° angle with respect to the upper surface of the cooking surface.

16. The home cooking appliance of claim 15, wherein the additional air includes a portion of the cooling air from the cooling air system.

17. The home cooking appliance of claim 15, wherein the rear vent trim includes a deflector that directs the additional air away from the 90° angle with respect to the upper surface of the cooking surface and through the opening in the rear vent trim.

18. The home cooking appliance of claim 1, further comprising:

a plurality of rear exhaust louvers on the housing, the plurality of rear exhaust louvers in fluid communication with the cooling air system and exhausting a portion of the cooling air from the cooling air system in an upward direction substantially in a plane of the rear wall of the housing to increase air pressure along the kitchen wall adjacent to the rear wall of the appliance; and a rear vent trim on the top of the housing and at the rear edge of the top of the housing, the rear vent trim having an upper surface that is substantially flush with the upper surface of the cooking surface, the rear vent trim including a plurality of openings permitting additional air to exit from the housing from the rear vent trim, and the rear vent trim directing the additional air away from a 90° angle with respect to the upper surface of the cooking surface.

19. A home cooking appliance comprising:

a housing;

a cooking surface on top of the housing, the cooking surface having an upper surface;

a cooking compartment in the housing;

a flue exhaust outlet on the housing and in fluid communication with a flue of the cooking compartment, the flue exhaust outlet exhausting flue gases from the cooking compartment from the top of the housing;

a cooling air system that conveys cooling air through the housing; and an exhaust outlet disposed at each rear corner of the housing, each rear corner being along a rear edge of the housing and a rear end of a side edge of the housing;

first means in fluid communication with the cooling air system and the exhaust outlet at each rear corner, the first means for exhausting a first stream of the cooling air in an upward direction from the exhaust outlet at each rear corner of the housing into a space above each rear corner of the housing for impeding a flow of the exhausted flue gases toward the side edge of the housing and directing the exhausted flue gases inward away from the side edge of the housing while maintaining acceptable temperatures at a kitchen wall adjacent to a rear wall of the housing.

20. The home cooking appliance of claim 19, further comprising:

second means for exhausting a second portion of the cooling air from the housing in an upward direction substantially in a plane of the rear wall of the housing to increase air pressure along the kitchen wall adjacent to the rear wall of the housing.

21. The home cooking appliance of claim 20, further comprising:

third means for exhausting a third portion of the cooling air from the cooling air system from the top of the housing.

22. The home cooking appliance of claim 1, wherein the at least one exhaust channel exhausts the first stream of the cooling air from the exhaust outlet at each rear corner at a 90° angle with respect to the upper surface of the cooking surface, and wherein the at least one exhaust channel exhausts a second stream of the cooling air from the exhaust outlet at each rear corner of the housing in a forward direction at an angle other than the 90° angle with respect to the upper surface of the cooking surface.

23. The home cooking appliance of claim 15, wherein the rear vent trim extends across the rear edge of the top of the housing and is parallel to the rear edge of the top of the housing.

24. The home cooking appliance of claim 1, further comprising:

a rear vent trim on the top of the housing and at the rear edge of the top of the housing, the rear vent trim having an upper surface that is substantially flush with the upper surface of the cooking surface, the rear vent trim including the exhaust outlet permitting the first stream of the cooling air to exit from the housing from the rear vent trim in the upward direction from the exhaust outlet between each rear corner of the cooking surface and each rear corner of the housing.

25. The home cooking appliance of claim 24, wherein the at least one exhaust channel exhausts a second stream of the cooling air from the exhaust outlet at each rear corner of the housing in a forward direction away from a 90° angle with respect to the upper surface of the cooking surface, wherein the rear vent trim includes a second opening permitting the second stream of the cooling air to exit from the housing from the rear vent trim in the forward direction away from the 90° angle with respect to the upper surface of the cooking surface.

26. The home cooking appliance of claim 24, wherein the rear vent trim extends across the rear edge of the top of the housing and is parallel to the rear edge of the top of the housing.

27. The home cooking appliance of claim 26, wherein the at least one exhaust channel exhausts a second stream of the cooling air from the exhaust outlet at each rear corner of the housing in a forward direction away from a 90° angle with respect to the upper surface of the cooking surface, and wherein the rear vent trim includes a second opening permitting the second stream of the cooling air to exit from the housing from the rear vent trim in the forward direction away from the 90° angle with respect to the upper surface of the cooking surface.

28. The home cooking appliance of claim 6, further comprising:

a rear vent trim on the top of the housing and at the rear edge of the top of the housing, the rear vent trim having an upper surface that is substantially flush with the upper surface of the cooking surface, wherein the rear vent trim includes:

a first opening permitting the first portion of the first stream of the cooling air to exit from the housing from the rear vent trim in the upward direction from the first rear corner of the housing; and a second opening permitting the second portion of the first stream of the cooling air to exit from the housing from the rear vent trim in the upward direction from the second rear corner of the housing.

29. The home cooking appliance of claim 19, wherein the first means is disposed along the rear edge of the housing and the rear end of each side edge of the housing.

30. The home cooking appliance of claim 1, further comprising:

a plurality of rear exhaust louvers on the housing, the plurality of rear exhaust louvers in fluid communication with the cooling air system and exhausting another portion of the cooling air from the cooling air system in an upward direction substantially in a plane of the rear wall of the housing and across a width of the rear wall of the housing to increase air pressure along the kitchen wall adjacent to the rear wall of the appliance.

31. The home cooking appliance of claim 1, wherein the at least one exhaust channel includes a first exhaust channel portion and a second exhaust channel portion, the first exhaust channel portion extending in a vertical direction at a first rear corner of the housing and the second exhaust channel portion extending in a vertical direction at a second rear corner of the housing.

32. The home cooking appliance of claim 31, further comprising:

a first channel having one end in fluid communication with the cooling air system and another end in fluid communication with the first exhaust channel portion, the first channel for guiding a first portion of the cooling air from the cooling air system to the first exhaust channel portion; and a second channel having one end in fluid communication with the cooling air system and another end in fluid communication with the second exhaust channel portion, the second channel for guiding a second portion of the cooling air from the cooling air system to the second exhaust channel portion.

33. The home cooking appliance of claim 32, wherein the first exhaust channel portion has an open end for exhausting the cooling air in the upward direction from the first rear corner of the housing, and the second exhaust channel portion has an open end for exhausting the cooling air in the upward direction from the second rear corner of the housing.

34. The home cooking appliance of claim 33, further comprising:

a rear vent trim on the top of the housing and at the rear edge of the top of the housing, the rear vent trim having an upper surface that is substantially flush with the upper surface of the cooking surface, the rear vent trim including one or more openings at each rear corner of the housing, the one or more openings permitting the cooling air to exit from the first exhaust channel portion and the second exhaust channel portion in at least the upward direction.

35. The home cooking appliance of claim 33, further comprising:

a first deflector at the open end of the first exhaust channel portion that directs a portion of the cooling air from the first exhaust channel portion at the first rear corner in the forward direction away from the 90° angle with respect to the upper surface of the cooking surface, and a second deflector at the open end of the second exhaust channel portion that directs another portion of the cooling air from the second exhaust channel portion at the second rear corner in the forward direction away from the 90° angle with respect to the upper surface of the cooking surface.

36. The home cooking appliance of claim 35, further comprising:

a rear vent trim on the top of the housing and at the rear edge of the top of the housing, the rear vent trim having an upper surface that is substantially flush with the upper surface of the cooking surface, the rear vent trim including one or more openings at each rear corner of the housing, the one or more openings permitting the cooling air to exit from the first exhaust channel portion and the second exhaust channel portion in the upward direction and the forward direction.

37. A home cooking appliance comprising:

a housing;

a cooking surface on top of the housing, the cooking surface having an upper surface;

a cooking compartment in the housing;

a flue exhaust outlet on the housing and in fluid communication with a flue of the cooking compartment, the flue exhaust outlet exhausting flue gases from the cooking compartment from the top of the housing;

a cooling air system that conveys cooling air through the housing;

exhaust outlets disposed at both rear corners of the housing, each of the rear corners being along a rear edge of the housing and a rear end of side edges of the housing; and one or more exhaust channels in fluid communication with the cooling air system and the exhaust outlets, the one or more exhaust channels exhausting a first stream of the cooling air in an upward direction from the exhaust outlets into a space above both rear corners of the housing and impeding a flow of the exhausted flue gases toward the side edges of the housing and directing the exhausted flue gases inward away from the side edges of the housing.

38. The home cooking appliance of claim 37, wherein the one or more exhaust channels further exhaust a second stream of the cooling air from the exhaust outlets at both rear corners of the housing in a forward direction away from a 90° angle with respect to the upper surface of the cooking surface.

39. The home cooking appliance of claim 38, further comprising:

a rear vent trim on the top of the housing and at the rear edge of the top of the housing, the rear vent trim having an upper surface that is substantially flush with the upper surface of the cooking surface, the rear vent trim including the exhaust outlets at both rear corners of the housing.

* * * * *